US012320346B2

(12) United States Patent
Kim et al.

(10) Patent No.: US 12,320,346 B2
(45) **Date of Patent: *Jun. 3, 2025**

(54) LINEAR COMPRESSOR INTAKE MUFFLER ARRANGEMENT WITH COMMUNICATION HOLE

(71) Applicant: LG Electronics Inc., Seoul (KR)

(72) Inventors: Junghae Kim, Seoul (KR); Kyeongweon Lee, Seoul (KR); Jinwoong Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 111 days.

This patent is subject to a terminal disclaimer.

(21) Appl. No.: 18/204,815

(22) Filed: Jun. 1, 2023

(65) Prior Publication Data

US 2024/0110556 A1 Apr. 4, 2024

(30) Foreign Application Priority Data

Sep. 30, 2022 (KR) ..... 10-2022-0124990

(51) Int. Cl.
*F04B 39/00* (2006.01)
*F04B 35/04* (2006.01)

(52) U.S. Cl.
CPC ..... *F04B 39/0061* (2013.01); *F04B 35/045* (2013.01)

(58) Field of Classification Search
CPC ..... F04B 39/0027; F04B 39/0061; F04B 39/123; F04B 37/00
See application file for complete search history.

(56) References Cited

U.S. PATENT DOCUMENTS 7,626,289 B2 * 12/2009 Her ..... F04B 35/045 310/15
7,748,963 B2 * 7/2010 Lee ..... F04B 39/0284 417/415

(Continued)

FOREIGN PATENT DOCUMENTS

CN 108561288 9/2018
CN 108561288 A * 9/2018 ..... F04B 39/0005

(Continued)

OTHER PUBLICATIONS

Extended European Search Report in European Appln. No. 23178880.3, mailed on Jan. 25, 2024, 5 pages.

(Continued)

*Primary Examiner* — Nathan C Zollinger
(74) *Attorney, Agent, or Firm* — Fish & Richardson P.C.

(57) ABSTRACT

A linear compressor includes a cylinder, a piston axially reciprocating in the cylinder, a first muffler unit coupled to the piston, a back cover that is disposed at a rear of the piston and defines an opening at a radially central area, and a second muffler unit coupled to the opening. The first muffler unit includes an inner guide disposed in the piston and a first intake muffler disposed at a rear of the inner guide. The second muffler unit includes a second intake muffler that communicates with the first intake muffler and is coupled to the opening, and a muffler body surrounding the second intake muffler. An outer circumferential surface of the second intake muffler defines a first communication hole communicating an inside of the second intake muffler with a space between the second intake muffler and the muffler body.

16 Claims, 19 Drawing Sheets

(56) References Cited

U.S. PATENT DOCUMENTS

| | | | | |
|---|---|---|---|---|
| 11,434,887 | B2 * | 9/2022 | Lee | F04B 39/0088 |
| 11,530,695 | B1 * | 12/2022 | Hahn | F04B 39/0027 |
| 2004/0247457 | A1 * | 12/2004 | Kim | F04B 35/045 417/416 |
| 2006/0091735 | A1 * | 5/2006 | Song | H02K 7/14 310/12.32 |
| 2021/0095656 | A1 * | 4/2021 | Lee | F04B 39/0088 |

FOREIGN PATENT DOCUMENTS

| | | | | |
|---|---|---|---|---|
| EP | 3511571 | A1 * | 7/2019 | F04B 35/04 |
| EP | 3783223 | | 2/2021 | |
| KR | 10-2001-0018433 | | 3/2001 | |
| KR | 101484324 | | 1/2015 | |
| KR | 10-2021-0039345 | | 4/2021 | |
| KR | 20210039345 | A * | 4/2021 | |

OTHER PUBLICATIONS

Office Action in Korean Appln. No. 10-2022-0124990, mailed on Feb. 5, 2024, 8 pages (with English translation).

* cited by examiner

LINEAR COMPRESSOR INTAKE MUFFLER ARRANGEMENT WITH COMMUNICATION HOLE

CROSS-REFERENCE TO RELATED APPLICATIONS

This application claims the benefit of Korea Patent Application No. 10-2022-0124990, filed on Sep. 30, 2022, which is incorporated herein by reference for all purposes as if fully set forth herein.

TECHNICAL FIELD

The present disclosure relates to a linear compressor. More specifically, the present disclosure relates to a linear compressor for compressing a refrigerant by a linear reciprocating motion of a piston.

BACKGROUND

A compressor refers to a device that is configured to receive power from a power generator such as a motor or a turbine and compress a working fluid such as air or refrigerant. The compressors may be used in industry or home appliances to perform a steam compression refrigeration cycle (hereinafter, referred to as "refrigeration cycle").

The compressors may be classified into a reciprocating compressor, a rotary compressor, and a scroll compressor depending on a method of compressing the refrigerant.

The reciprocating compressor may define a compression space between a piston and a cylinder, and the piston linearly reciprocates to compress a fluid. The rotary compressor may compress a fluid by a roller that eccentrically rotates inside a cylinder. The scroll compressor may compress a fluid by engaging and rotating a pair of spiral scrolls.

In some cases, among the reciprocating compressors, linear compressors may use a linear reciprocating motion without using a crank shaft is gradually increasing. The linear compressor may have advantages in that it has less mechanical loss resulting from switching a rotary motion to the linear reciprocating motion and thus can improve the efficiency, and has a relatively simple structure.

In some cases, a linear compressor may include a cylinder positioned in a casing forming a sealed space to form a compression chamber, and a piston covering the compression chamber that reciprocates in the cylinder. The linear compressor repeats a process in which a fluid in the sealed space is suctioned into the compression chamber while the piston is positioned at a bottom dead center (BDC), and the fluid of the compression chamber is compressed and discharged while the piston is positioned at a top dead center (TDC).

The linear compressor may include a compression unit and a drive unit installed inside the linear compressor. The compression unit performs a process of compressing and discharging a refrigerant while performing a resonant motion by a resonant spring through a movement generated in the drive unit.

The piston of the linear compressor repeatedly performs a series of processes of suctioning the refrigerant into the casing through an intake pipe while reciprocating at high speed inside the cylinder by the resonant spring, and then discharging the refrigerant from a compression space through a forward movement of the piston to move it to a condenser through a discharge pipe.

The linear compressor may be classified into an oil lubricated linear compressor and a gas lubricated linear compressor according to a lubrication method. The oil lubricated linear compressor is configured to store a predetermined amount of oil in the casing and lubricate between the cylinder and the piston using the oil. The gas lubricated linear compressor is configured not to store an oil in the casing, induce a part of the refrigerant discharged from the compression space between the cylinder and the piston, and lubricate between the cylinder and the piston by a gas force of the refrigerant.

The oil lubricated linear compressor supplies the oil of a relatively low temperature between the cylinder and the piston and thus can suppress the cylinder and the piston from being overheated by motor heat or compression heat, etc. Hence, the oil lubricated linear compressor suppresses specific volume from increasing as the refrigerant passing through an intake flow path of the piston is suctioned into the compression chamber of the cylinder and is heated, and thus can prevent in advance an intake loss from occurring.

In some cases, when the refrigerant and an oil discharged to a refrigeration cycle device are not smoothly returned to the compressor, the oil lubricated linear compressor may experience an oil shortage in the casing of the compressor. The oil shortage in the casing may lead to a reduction in reliability of the compressor.

In some cases, the gas lubricated linear compressor may have advantages in that it can be made smaller than the oil lubricated linear compressor, and there is less reduction in the reliability of the compressor due to the oil shortage because it lubricates between the cylinder and the piston using the refrigerant.

A muffler unit for noise reduction may be coupled to the piston. In some cases, the noise reduction effect may be lowered due to a limited space.

SUMMARY

The present disclosure describes a linear compressor configured to improve noise filtering characteristics through an additional expansion room of a second muffler unit.

The present disclosure further describes a linear compressor configured to improve space efficiency.

The present disclosure further describes a linear compressor configured to improve intake efficiency of a refrigerant.

According to one aspect of the subject matter described in this application, a linear compressor includes a cylinder, a piston configured to axially reciprocate in the cylinder, a back cover disposed at a rear of the piston, the back cover defining an opening at a central area thereof in a radial direction, a first muffler unit coupled to the piston, the first muffler unit including (i) an inner guide disposed in the piston and (ii) a first intake muffler disposed between the inner guide and the back cover, a second muffler unit including (i) a second intake muffler that is in fluid communication with the first intake muffler and is coupled to the opening and (ii) a muffler body that surrounds the second intake muffler. An outer circumferential surface of the second intake muffler defines a first communication hole that fluidly communicates an inside of the second intake muffler with a first space that is defined radially between the second intake muffler and the muffler body.

Through this, the present disclosure can improve noise filtering characteristics through an additional expansion room of the second muffler unit.

A diameter of the second intake muffler may be greater than a diameter of the first intake muffler.

In this case, the space between the second intake muffler and the muffler body does not axially overlap the first intake muffler, and only a part of the space between the second intake muffler and the muffler body may axially overlap the piston.

Through this, the present disclosure can improve noise filtering characteristics of the muffler unit while increasing space efficiency.

The second intake muffler may include a first cylindrical portion, a first flange that extends radially outward from a front of the first cylindrical portion and radially overlaps a front end of the muffler body, a second flange extending radially outward from a central area of the first cylindrical portion, and a coupling portion that extends radially outward from a rear area of the first cylindrical portion and is coupled to the opening.

In this case, the first communication hole may be disposed between the first flange and the second flange.

Through this, the present disclosure can increase space efficiency of the second muffler unit and improve noise filtering characteristics of the second muffler unit.

The muffler body may include a second cylindrical portion disposed at a radially outside of the second intake muffler, and in which a front and a rear of a central area are opened, a front of a space between an inner surface and an outer surface is closed, and a rear of the space between the inner surface and the outer surface is opened, and a third flange extending inward from the inner surface of the second cylindrical portion. A rear surface of the second flange may contact a front surface of the third flange.

In addition, the second muffler unit may further include a muffler cover disposed between the muffler body and the back cover. The outer circumferential surface of the second intake muffler may further include a second communication hole that is disposed between the first flange and the coupling portion and communicates the inside of the second intake muffler with a space between the second intake muffler, the muffler body, the muffler cover, and the back cover.

In this case, a diameter of the space between the second intake muffler, the muffler body, the muffler cover, and the back cover may be greater than a diameter of the space between the second intake muffler and the muffler body.

Through this, since an additional expansion space is provided, noise reduction efficiency of the second muffler unit can be improved.

The second intake muffler may include a partition wall partitioning an inner space of the first cylindrical portion, and the partition wall may radially overlap the space between the second intake muffler, the muffler body, the muffler cover, and the back cover.

Through this, the present disclosure can improve space efficiency while improving intake efficiency of a refrigerant.

The muffler cover may include a ring portion extending in a circumferential direction, a first extension extending rearward from an outer end of the ring portion, and a second extension extending forward from an inner end of the ring portion. An outer surface of the first extension and an inner surface of the second extension may contact the second cylindrical portion.

In this case, the ring portion may seal a rear opened between the inner surface and the outer surface of the second cylindrical portion, and the outer surface of the first extension may contact the second cylindrical portion.

Further, the second cylindrical portion may include a resonance communication hole that is formed in the inner surface of the second cylindrical portion and communicates a space between the second intake muffler and the second cylindrical portion with a space between the second cylindrical portion and the ring portion.

Through this, since an additional expansion space is provided, noise reduction efficiency of the second muffler unit can be improved.

In another aspect of the present disclosure, a linear compressor includes a cylinder, a piston configured to axially reciprocate in the cylinder, a back cover axially spaced apart from the piston, the back cover defining an opening at a central area in a radial direction, and a muffler unit including (i) an intake muffler coupled to the opening and (ii) a muffler body surrounding the intake muffler, where an outer circumferential surface of the intake muffler defines a first communication hole that fluidly communicates an inside of the intake muffler with a first space that is defined radially between the intake muffler and the muffler body.

Through this, the present disclosure can improve noise filtering characteristics through an expansion room of the muffler unit.

The intake muffler may include a first cylindrical portion, a first flange that extends radially outward from a front of the first cylindrical portion and radially overlaps a front end of the muffler body, a second flange extending radially outward from a central area of the first cylindrical portion, and a coupling portion that extends radially outward from a rear area of the first cylindrical portion and is coupled to the opening.

In this case, the first communication hole may be disposed between the first flange and the second flange.

Through this, the present disclosure can increase space efficiency of the muffler unit.

The muffler body includes a second cylindrical portion disposed at a radially outside of the intake muffler, and in which a front and a rear of a central area are opened, a front of a space between an inner surface and an outer surface is closed, and a rear of the space between the inner surface and the outer surface is opened, and a third flange extending inward from the inner surface of the second cylindrical portion. A rear surface of the second flange may contact a front surface of the third flange.

In addition, the muffler unit may further include a muffler cover disposed between the muffler body and the back cover. The outer circumferential surface of the intake muffler may further include a second communication hole that is disposed between the first flange and the coupling portion and communicates the inside of the intake muffler with a space between the intake muffler, the muffler body, the muffler cover, and the back cover.

In this case, a diameter of the space between the intake muffler, the muffler body, the muffler cover, and the back cover may be greater than a diameter of the space between the intake muffler and the muffler body.

Through this, since an additional expansion space is provided, noise reduction efficiency of the muffler unit can be improved.

The intake muffler may include a partition wall partitioning an inner space of the first cylindrical portion, and the partition wall may radially overlap the space between the intake muffler, the muffler body, the muffler cover, and the back cover.

Through this, the present disclosure can improve space efficiency while improving intake efficiency of a refrigerant.

The muffler cover may include a ring portion extending in a circumferential direction, a first extension extending rearward from an outer end of the ring portion, and a second extension extending forward from an inner end of the ring portion. An outer surface of the first extension and an inner surface of the second extension may contact the second cylindrical portion. The ring portion may seal a rear opened between the inner surface and the outer surface of the second cylindrical portion. The outer surface of the first extension may contact the second cylindrical portion. The second cylindrical portion may include a resonance communication hole that is formed in the inner surface of the second cylindrical portion and communicates a space between the intake muffler and the second cylindrical portion with a space between the second cylindrical portion and the ring portion.

Through this, since an additional expansion space is provided, noise reduction efficiency of the muffler unit can be improved.

BRIEF DESCRIPTION OF THE DRAWINGS

The accompanying drawings, which are included to provide a further understanding of the present disclosure and constitute a part of the detailed description, illustrate implementations of the present disclosure and serve to explain technical features of the present disclosure together with the description.

DETAILED DESCRIPTION

Reference will now be made in detail to implementations of the present disclosure, examples of which are illustrated in the accompanying drawings. Wherever possible, the same reference numbers will be used throughout the drawings to refer to the same or like parts.

Figure 1:
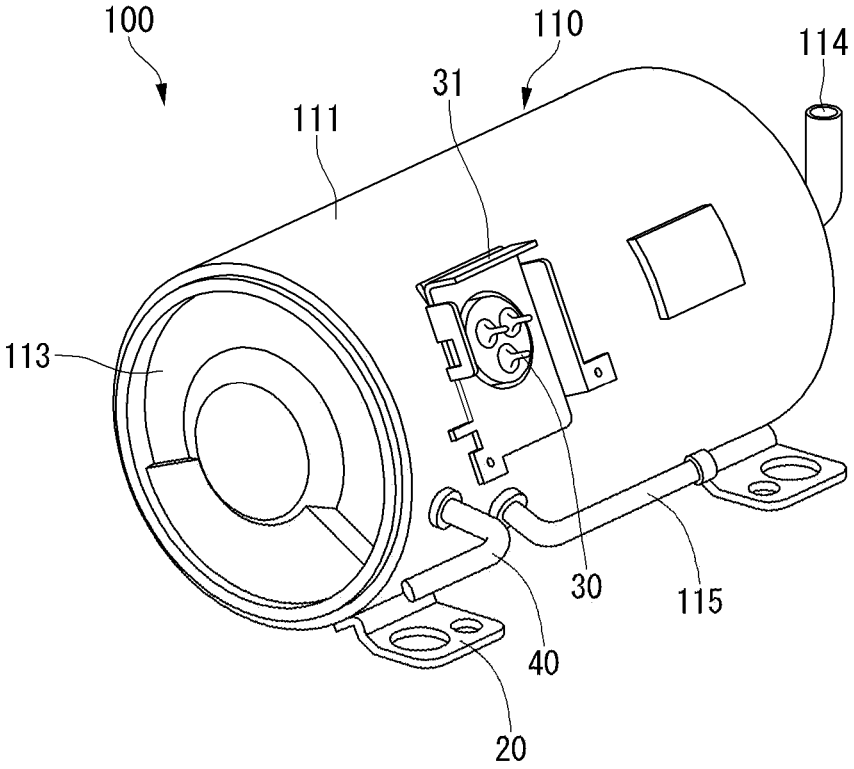
FIG. 1 is a perspective view showing an example of a linear compressor.

FIG. 1 is a perspective view showing an example of a linear compressor.

Referring to FIG. 1, in some implementations, a linear compressor 100 can include a shell 111 and shell covers 112 and 113 coupled to the shell 111. In a broad sense, the shell covers 112 and 113 can be understood as one configuration of the shell 111.

In some examples, legs 20 can be coupled to a lower side of the shell 111. The legs 20 can be coupled to a base of a product on which the linear compressor 100 is mounted. For example, the product can include a refrigerator, and the base can include a machine room base of the refrigerator. As another example, the product can include an outdoor unit of an air conditioner, and the base can include a base of the outdoor unit.

The shell 111 can have a substantially cylindrical shape and can be disposed to lie in a horizontal direction or an axial direction. FIG. 1 illustrates that the shell 111 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

A longitudinal central axis of the shell 111 coincides with a central axis of a main body of the linear compressor 100 to be described below, and the central axis of the main body of the linear compressor 100 can coincide with a central axis of a cylinder 140 and a piston 150 that constitute the main body of the linear compressor 100.

A terminal 30 can be installed on an outer surface of the shell 111. The terminal 30 can transmit external electric power to a drive unit 130 of the linear compressor 100. More specifically, the terminal 30 can be connected to a lead line of a coil 132*b*.

A bracket 31 can be installed on the outside of the terminal 30. The bracket 31 can include a plurality of brackets surrounding the terminal 30. The bracket 31 can perform a function of protecting the terminal 30 from an external impact, etc.

Both sides of the shell 111 can be opened. The shell covers 112 and 113 can be coupled to both sides of the opened shell 111. More specifically, the shell covers 112 and 113 can include a first shell cover 112 coupled to one opened side of the shell 111 and a second shell cover 113 coupled to the other opened side of the shell 111. An inner space of the shell 111 can be sealed by the shell covers 112 and 113.

FIG. 1 illustrates that the first shell cover 112 is positioned on the right side of the linear compressor 100, and the second shell cover 113 is positioned on the left side of the linear compressor 100, by way of example. In other words, the first and second shell covers 112 and 113 can be disposed to face each other. It can be understood that the first shell cover 112 is positioned on an intake side of a refrigerant, and the second shell cover 113 is positioned on a discharge side of the refrigerant.

The linear compressor 100 can include a plurality of pipes 114, 115, and 40 that are included in the shell 111 or the shell covers 112 and 113 and can suction, discharge, or inject the refrigerant.

The plurality of pipes 114, 115, and 40 can include an intake pipe 114 that allows the refrigerant to be suctioned into the linear compressor 100, a discharge pipe 115 that allows the compressed refrigerant to be discharged from the linear compressor 100, and a supplementary pipe 40 for supplementing the refrigerant in the linear compressor 100.

For example, the intake pipe 114 can be coupled to the first shell cover 112. The refrigerant can be suctioned into the linear compressor 100 along the axial direction through the intake pipe 114.

The discharge pipe 115 can be coupled to an outer circumferential surface of the shell 111. The refrigerant suctioned through the intake pipe 114 can be compressed while flowing in the axial direction. The compressed refrigerant can be discharged through the discharge pipe 115. The discharge pipe 115 can be disposed closer to the second shell cover 113 than to the first shell cover 112.

The supplementary pipe 40 can be coupled to the outer circumferential surface of the shell 111. A worker can inject the refrigerant into the linear compressor 100 through the supplementary pipe 40.

The supplementary pipe 40 can be coupled to the shell 111 at a different height from the discharge pipe 115 in order to prevent interference with the discharge pipe 115. Herein, the height can be understood as a distance measured from the leg 20 in a vertical direction. Because the discharge pipe 115 and the supplementary pipe 40 are coupled to the outer circumferential surface of the shell 111 at different heights, the work convenience can be attained.

On an inner circumferential surface of the shell 111 corresponding to a location at which the supplementary pipe 40 is coupled, at least a portion of the second shell cover 113 can be positioned adjacently. In other words, at least a portion of the second shell cover 113 can act as a resistance of the refrigerant injected through the supplementary pipe 40.

Thus, with respect to a flow path of the refrigerant, a size of the flow path of the refrigerant introduced through the supplementary pipe 40 can be configured to decrease by the second shell cover 113 while the refrigerant enters into the inner space of the shell 111, and to increase again while the refrigerant passes through the second shell cover 113. In this process, a pressure of the refrigerant can be reduced to vaporize the refrigerant, and an oil contained in the refrigerant can be separated. Thus, while the refrigerant, from which the oil is separated, is introduced into the piston 150, a compression performance of the refrigerant can be improved. The oil can be understood as a working oil present in a cooling system.

Figure 2:
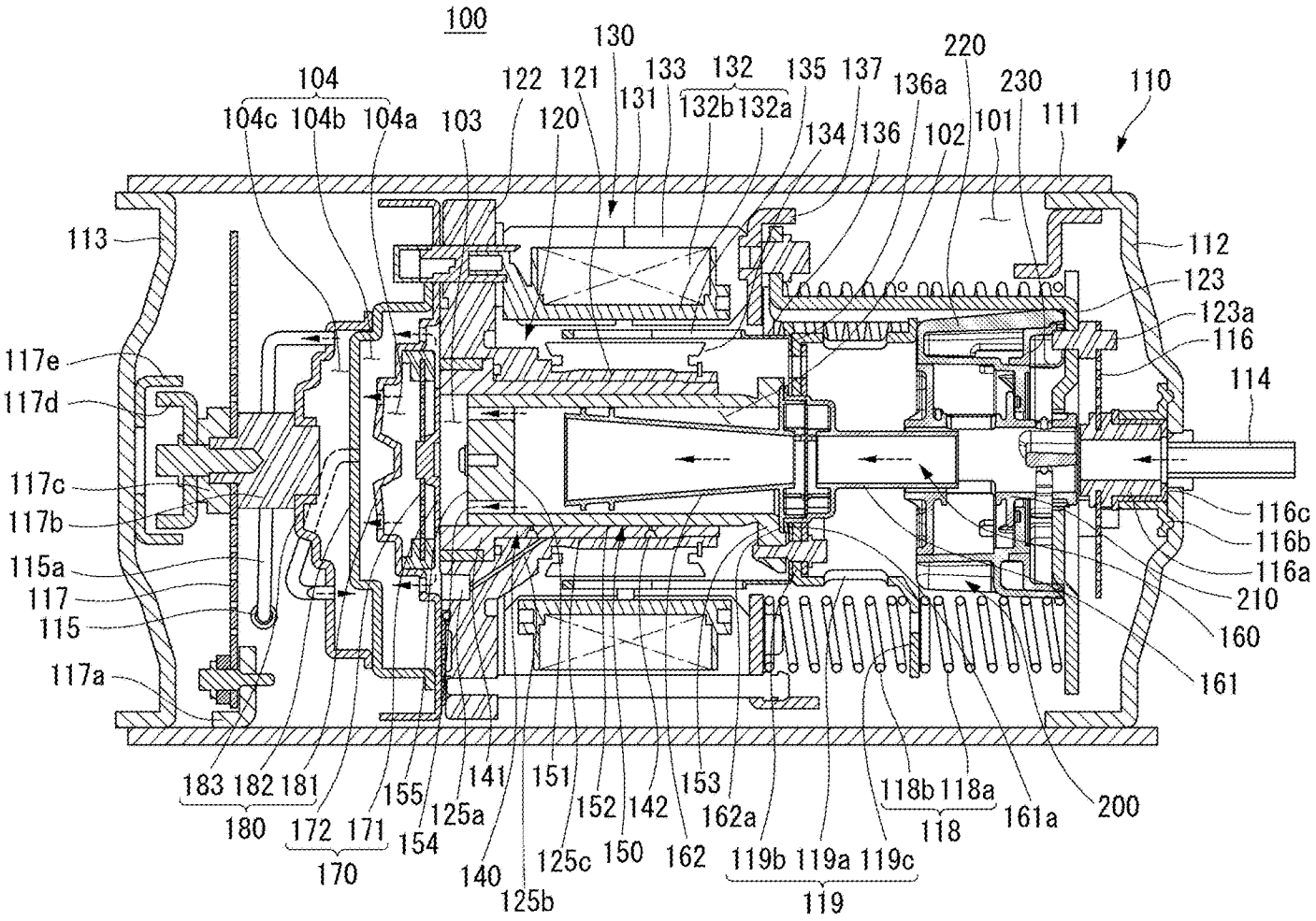
FIG. 2 is a cross-sectional view showing the linear compressor.

FIG. 2 is a cross-sectional view illustrating an example structure of the linear compressor 100.

Hereinafter, the linear compressor according to the present disclosure will be described taking, as an example, a linear compressor that suctions and compresses a fluid while a piston linearly reciprocates, and discharges the compressed fluid.

A linear compressor can be a component of a refrigeration cycle, and a fluid compressed in the linear compressor can be a refrigerant circulating the refrigeration cycle. The refrigeration cycle can include a condenser, an expander, an evaporator, etc., in addition to the linear compressor. The linear compressor can be used as a component of a cooling system of a refrigerator, but is not limited thereto. The linear compressor can be widely used in the whole industry.

Referring to FIG. 2, the linear compressor 100 can include a casing 110 and a main body received in the casing 110. The main body of the linear compressor 100 can include a frame 120, the cylinder 140 fixed to the frame 120, the piston 150 that linearly reciprocates inside the cylinder 140, the drive unit 130 that is fixed to the frame 120 and gives a driving force to the piston 150, and the like. For example, the cylinder 140 and the piston 150 can be referred to as compression units 140 and 150.

The linear compressor 100 can include a bearing for reducing a friction between the cylinder 140 and the piston 150. For instance, the bearing can include an oil bearing or a gas bearing. Alternatively, a mechanical bearing can be used as the bearing.

The main body of the linear compressor 100 can be elastically supported by support springs 116 and 117 installed at both ends in the casing 110. The support springs 116 and 117 can include a first support spring 116 for supporting the rear of the main body and a second support spring 117 for supporting a front of the main body. The support springs 116 and 117 can include a leaf spring. The support springs 116 and 117 can absorb vibrations and impacts generated by a reciprocating motion of the piston 150 while supporting the internal components of the main body of the linear compressor 100.

The casing 110 can define a sealed space. The sealed space can include an accommodation space 101 in which the suctioned refrigerant is received, an intake space 102 which is filled with the refrigerant before the compression, a compression space 103 in which the refrigerant is compressed, and a discharge space 104 which is filled with the compressed refrigerant.

The refrigerant suctioned from the intake pipe 114 connected to the rear side of the casing 110 can be filled in the accommodation space 101, and the refrigerant in the intake space 102 communicating with the accommodation space 101 can be compressed in the compression space 103, discharged into the discharge space 104, and discharged to the outside through the discharge pipe 115 connected to the front side of the casing 110.

The casing 110 can include the shell 111 formed in a substantially cylindrical shape that is open at both ends and is long in a transverse direction, the first shell cover 112 coupled to the rear side of the shell 111, and the second shell cover 113 coupled to the front side of the shell 111. For instance, the front side is the left side of the figure and is a direction in which the compressed refrigerant is discharged, and the rear side is the right side of the figure and is a direction in which the refrigerant is introduced. Further, the first shell cover 112 and the second shell cover 113 can be formed as one body with the shell 11.

The casing 110 can be formed of a thermally conductive material. Hence, heat generated in the inner space of the casing 110 can be quickly dissipated to the outside.

The first shell cover 112 can be coupled to the shell 111 in order to seal the rear side of the shell 111, and the intake pipe 114 can be inserted and coupled to the center of the first shell cover 112.

The rear side of the main body of the linear compressor 100 can be elastically supported by the first support spring 116 in the radial direction of the first shell cover 112.

The first support spring 116 can include a circular leaf spring. An edge portion of the first support spring 116 can be elastically supported by a support bracket **123*a* in a forward direction with respect to a back cover 123. An opened center portion of the first support spring 116 can be supported by an intake guide 116*a* in a rearward direction with respect to the first shell cover 112**.

The intake guide **116*a* can have a through passage formed therein. The intake guide 116*a* can be formed in a cylindrical shape. A front outer circumferential surface of the intake guide 116*a* can be coupled to a central opening of the first support spring 116, and a rear end of the intake guide 116*a* can be supported by the first shell cover 112. In this instance, a separate intake support member 116***b* can be interposed between the intake guide 116*a* and an inner surface of the first shell cover 112.

A rear side of the intake guide 116*a* can communicate with the intake pipe 114, and the refrigerant suctioned through the intake pipe 114 can pass through the intake guide 116*a* and can be smoothly introduced into a first muffler unit 160 to be described below.

A damping member 116*c* can be disposed between the intake guide 116*a* and the intake support member 116*b*. The damping member 116*c* can be formed of a rubber material or the like. Hence, a vibration that can occur in the process of suctioning the refrigerant through the intake pipe 114 can be prevented from being transmitted to the first shell cover 112.

The second shell cover 113 can be coupled to the shell 111 to seal the front side of the shell 111, and the discharge pipe 115 can be inserted and coupled through a loop pipe 115*a*. The refrigerant discharged from the compression space 103 can pass through a discharge cover assembly 180 and then can be discharged into the refrigeration cycle through the loop pipe 115*a* and the discharge pipe 115.

A front side of the main body of the compressor 100 can be elastically supported by the second support spring 117 in the radial direction of the shell 111 or the second shell cover 113. The second support spring 117 can include a circular leaf spring. An opened center portion of the second support spring 117 can be supported by a first support guide 117*b* in a rearward direction with respect to the discharge cover assembly 180. An edge of the second support spring 117 can be supported by a support bracket 117*a* in a forward direction with respect to an inner surface of the shell 111 or the inner circumferential surface of the shell 111 adjacent to the second shell cover 113.

In some examples, unlike FIG. 2, the edge of the second support spring 117 can be supported in the forward direction with respect to the inner surface of the shell 111 or the inner circumferential surface of the shell 111 adjacent to the second shell cover 113 through a separate bracket coupled to the second shell cover 113.

The first support guide 117*b* can be formed in a cylindrical shape. A cross section of the first support guide 117*b* can have a plurality of diameters. A front side of the first support guide 117*b* can be inserted into a central opening of the second support spring 117, and a rear side of the first support guide 117*b* can be connected to the discharge cover assembly 180. A support cover 117*c* can be coupled to the front side of the first support guide 117*b* with the second support spring 117 interposed therebetween. A cup-shaped second support guide 117*d* that is recessed rearward can be coupled to the front side of the support cover 117*c*. A cup-shaped third support guide 117*e* that corresponds to the second support guide 117*d* and is recessed forward can be coupled to the inside of the second shell cover 113. The second support guide 117*d* can be inserted into the third support guide 117*e* and can be supported in the axial direction and/or the radial direction. In this instance, a gap can be formed between the second support guide 117*d* and the third support guide 117*e*.

The frame 120 can include a body portion 121 supporting the outer circumferential surface of the cylinder 140, and a first flange portion 122 that is connected to one side of the body portion 121 and supports the drive unit 130. The frame 120 can be elastically supported with respect to the casing 110 by the first and second support springs 116 and 117 together with the drive unit 130 and the cylinder 140.

The body portion 121 can wrap the outer circumferential surface of the cylinder 140. The body portion 121 can be formed in a cylindrical shape. The first flange portion 122 can extend from a front end of the body portion 121 in the radial direction.

The cylinder 140 can be coupled to an inner circumferential surface of the body portion 121. An inner stator 134 can be coupled to an outer circumferential surface of the body portion 121. For example, the cylinder 140 can be pressed and fitted to the inner circumferential surface of the body portion 121, and the inner stator 134 can be fixed using a separate fixing ring.

An outer stator 131 can be coupled to a rear surface of the first flange portion 122, and the discharge cover assembly 180 can be coupled to a front surface of the first flange portion 122. For example, the outer stator 131 and the discharge cover assembly 180 can be fixed through a mechanical coupling member.

On one side of the front surface of the first flange portion 122, a bearing inlet groove 125*a* forming a part of the gas bearing can be formed, a bearing communication hole 125*b* penetrating from the bearing inlet groove 125*a* to the inner circumferential surface of the body portion 121 can be formed, and a gas groove 125*c* communicating with the bearing communication hole 125*b* can be formed on the inner circumferential surface of the body portion 121.

The bearing inlet groove 125*a* can be recessed to a predetermined depth along the axial direction. The bearing communication hole 125*b* is a hole having a smaller cross-sectional area than the bearing inlet groove 125*a* and can be inclined toward the inner circumferential surface or the inside surface of the body portion 121. The gas groove 125*c* can be formed in an annular shape having a predetermined depth and an axial length on the inner circumferential surface of the body portion 121. Alternatively, the gas groove 125*c* can be formed on the outer circumferential surface of the cylinder 140 in contact with the inner circumferential surface of the body portion 121, or formed on both the inner circumferential surface of the body portion 121 and the outer circumferential surface of the cylinder 140.

In addition, a gas inlet 142 corresponding to the gas groove 125*c* can be formed on the outer circumferential surface of the cylinder 140. The gas inlet 142 forms a kind of nozzle in the gas bearing.

The frame 120 and the cylinder 140 can be formed of aluminum or an aluminum alloy material.

The cylinder 140 can be formed in a cylindrical shape in which both ends are opened. The piston 150 can be inserted through a rear end of the cylinder 140. A front end of the cylinder 140 can be closed via a discharge valve assembly 170. The compression space 103 can be formed between the cylinder 140, a front end of the piston 150, and the discharge valve assembly 170. For example, the front end of the piston 150 can be referred to as a head portion 151. The volume of the compression space 103 increases when the piston 150 moves backward, and decreases as the piston 150 moves forward. That is, the refrigerant introduced into the compression space 103 can be compressed while the piston 150 moves forward, and can be discharged through the discharge valve assembly 170.

The cylinder 140 can include a second flange portion 141 disposed at the front end. The second flange portion 141 can bend to the outside of the cylinder 140. The second flange portion 141 can extend in an outer circumferential direction of the cylinder 140. The second flange portion 141 of the cylinder 140 can be coupled to the frame 120. For example, the front end of the frame 120 can include a flange groove corresponding to the second flange portion 141 of the cylinder 140, and the second flange portion 141 of the cylinder 140 can be inserted into the flange groove and coupled through a coupling member.

In some implementations, a gas bearing can be provided to supply a discharge gas to a gap between the outer circumferential surface of the piston 150 and the outer circumferential surface of the cylinder 140 and lubricate between the cylinder 140 and the piston 150 with gas. The discharge gas supplied between the cylinder 140 and the piston 150 can provide a levitation force to the piston 150 to reduce a friction generated between the piston 150 and the cylinder 140.

For example, the cylinder 140 can include the gas inlet 142. The gas inlet 142 can communicate with the gas groove 125*c* formed on the inner circumferential surface of the body portion 121. The gas inlet 142 can pass through the cylinder 140 in the radial direction. The gas inlet 142 can guide the compressed refrigerant introduced in the gas groove 125*c* between the inner circumferential surface of the cylinder 140 and the outer circumferential surface of the piston 150. Alternatively, the gas groove 125*c* can be formed on the outer circumferential surface of the cylinder 140 in consideration of the convenience of processing.

An entrance of the gas inlet 142 can be formed relatively widely, and an exit of the gas inlet 142 can be formed as a fine through hole to serve as a nozzle. The entrance of the gas inlet 142 can further include a filter blocking the inflow of foreign matter. The filter can be a metal mesh filter, or can be formed by winding a member such as fine thread.

The plurality of gas inlets 142 can be independently formed. Alternatively, the entrance of the gas inlet 142 can be formed as an annular groove, and a plurality of exits can be formed along the annular groove at regular intervals. The gas inlet 142 can be formed only at the front side based on the axial direction center of the cylinder 140. On the contrary, the gas inlet 142 can be formed at the rear side based on the axial direction center of the cylinder 140 in consideration of the sagging of the piston 150.

The piston 150 is inserted into the opened rear end of the cylinder 140 and is provided to seal the rear of the compression space 103.

The piston 150 can include a head portion 151 and a guide portion 152. The head portion 151 can be formed in a disc shape. The head portion 151 can be partially open. The head portion 151 can partition the compression space 103. The guide portion 152 can extend rearward from an outer circumferential surface of the head portion 151. The guide portion 152 can be formed in a cylindrical shape. The inside of the guide portion 152 can be empty, and a front of the guide portion 152 can be partially sealed by the head portion 151. A rear of the guide portion 152 can be opened and connected to the first muffler unit 160. The head portion 151 can be provided as a separate member coupled to the guide portion 152. Alternatively, the head portion 151 and the guide portion 152 can be formed as one body.

The piston 150 can include an intake port 154. The intake port 154 can pass through the head portion 151. The intake port 154 can communicate with the intake space 102 and the compression space 103 inside the piston 150. For example, the refrigerant flowing from the accommodation space 101 to the intake space 102 in the piston 150 can pass through the intake port 154 and can be suctioned into the compression space 103 between the piston 150 and the cylinder 140.

The intake port 154 can extend in the axial direction of the piston 150. The intake port 154 can be inclined in the axial direction of the piston 150. For example, the intake port 154 can extend to be inclined in a direction away from the central axis as it goes to the rear of the piston 150.

A cross section of the intake port 154 can be formed in a circular shape. The intake port 154 can have a constant inner diameter. In contrast, the intake port 154 can be formed as a long hole in which an opening extends in the radial direction of the head portion 151, or can be formed such that the inner diameter becomes larger as it goes to the rear.

The plurality of intake ports 154 can be formed in at least one of the radial direction and the circumferential direction of the head portion 151.

The head portion 151 of the piston 150 adjacent to the compression space 103 can be equipped with an intake valve 155 for selectively opening and closing the intake port 154. The intake valve 155 can operate by elastic deformation to open or close the intake port 154. That is, the intake valve 155 can be elastically deformed to open the intake port 154 by the pressure of the refrigerant flowing into the compression space 103 through the intake port 154. The intake valve 155 can be a lead valve, but is not limited thereto and can be variously changed.

The piston 150 can be connected to a mover 135. The mover 135 can reciprocate forward and backward according to the movement of the piston 150. The inner stator 134 and the cylinder 140 can be disposed between the mover 135 and the piston 150. The mover 135 and the piston 150 can be connected to each other by a magnet frame 136 that is formed by detouring the cylinder 140 and the inner stator 134 to the rear.

The first muffler unit 160 can be coupled to the rear of the piston 150 to reduce a noise generated in the process of suctioning the refrigerant into the piston 150. The refrigerant suctioned through the intake pipe 114 can flow into the intake space 102 in the piston 150 via the first muffler unit 160.

The first muffler unit 160 can include a first intake muffler 161 communicating with the accommodation space 101 of the casing 110, and an inner guide 162 that is connected to a front of the first intake muffler 161 and guides the refrigerant to the intake port 154.

The first intake muffler 161 can be positioned behind the piston 150. A rear opening of the first intake muffler 161 can be disposed adjacent to the intake pipe 114, and a front end of the first intake muffler 161 can be coupled to the rear of the piston 150. The first intake muffler 161 can have a flow path formed in the axial direction to guide the refrigerant in the accommodation space 101 to the intake space 102 inside the piston 150.

The inside of the first intake muffler 161 can include a plurality of noise spaces partitioned by a baffle. The first intake muffler 161 can be formed by combining two or more members. For example, a second intake muffler can be press-coupled to the inside of a first intake muffler to form a plurality of noise spaces. In addition, the first intake muffler 161 can be formed of a plastic material in consideration of weight or insulation property.

One side of the inner guide 162 can communicate with the noise space of the first intake muffler 161, and other side can be deeply inserted into the piston 150. The inner guide 162 can be formed in a pipe shape. Both ends of the inner guide 162 can have the same inner diameter. The inner guide 162 can be formed in a cylindrical shape. Alternatively, an inner diameter of a front end that is a discharge side of the inner guide 162 can be greater than an inner diameter of a rear end opposite the front end.

The first intake muffler 161 and the inner guide 162 can be provided in various shapes and can adjust the pressure of the refrigerant passing through the first muffler unit 160. The first intake muffler 161 and the inner guide 162 can be formed as one body.

The discharge valve assembly 170 can include a discharge valve 171 and a valve spring 172 that is provided on a front side of the discharge valve 171 to elastically support the discharge valve 171. The discharge valve assembly 170 can selectively discharge the compressed refrigerant in the compression space 103. For instance, the compression space 103 refers to a space defined between the intake valve 155 and the discharge valve 171.

The discharge valve 171 can be disposed to be supportable on the front surface of the cylinder 140. The discharge valve 171 can selectively open and close the front opening of the cylinder 140. The discharge valve 171 can operate by elastic deformation to open or close the compression space 103. The discharge valve 171 can be elastically deformed to open the compression space 103 by the pressure of the refrigerant flowing into the discharge space 104 through the compression space 103. For example, the compression space 103 can maintain a sealed state while the discharge valve 171 is supported on the front surface of the cylinder 140, and the compressed refrigerant of the compression space 103 can be discharged into an opened space in a state where the discharge valve 171 is spaced apart from the front surface of the cylinder 140. The discharge valve 171 can be a lead valve, but is not limited thereto and can be variously changed.

The valve spring 172 can be provided between the discharge valve 171 and the discharge cover assembly 180 to provide an elastic force in the axial direction. The valve spring 172 can be provided as a compression coil spring, or can be provided as a leaf spring in consideration of an occupied space or reliability.

When the pressure of the compression space 103 is equal to or greater than a discharge pressure, the valve spring 172 can open the discharge valve 171 while deforming forward, and the refrigerant can be discharged from the compression space 103 and discharged into a first discharge space 104*a* of the discharge cover assembly 180. When the discharge of the refrigerant is completed, the valve spring 172 provides a restoring force to the discharge valve 171 and thus can allow the discharge valve 171 to be closed.

A process of introducing the refrigerant into the compression space 103 through the intake valve 155 and discharging the refrigerant of the compression space 103 into the discharge space 104 through the discharge valve 171 is described as follows.

In the process in which the piston 150 linearly reciprocates in the cylinder 140, when the pressure of the compression space 103 is equal to or less than a predetermined intake pressure, the intake valve 155 is opened and thus the refrigerant is suctioned into a compression space 103. On the other hand, when the pressure of the compression space 103 exceeds the predetermined intake pressure, the refrigerant of the compression space 103 is compressed in a state in which the intake valve 155 is closed.

When the pressure of the compression space 103 is equal to or greater than the predetermined intake pressure, the valve spring 172 deforms forward and opens the discharge valve 171 connected to the valve spring 172, and the refrigerant is discharged from the compression space 103 to the discharge space 104 of the discharge cover assembly 180. When the discharge of the refrigerant is completed, the valve spring 172 provides a restoring force to the discharge valve 171 and allows the discharge valve 171 to be closed, thereby sealing a front of the compression space 103.

The discharge cover assembly 180 is installed at the front of the compression space 103, forms a discharge space 104 for receiving the refrigerant discharged from the compression space 103, and is coupled to a front of the frame 120 to thereby reduce a noise generated in the process of discharging the refrigerant from the compression space 103. The discharge cover assembly 180 can be coupled to a front of the first flange portion 122 of the frame 120 while receiving the discharge valve assembly 170. For example, the discharge cover assembly 180 can be coupled to the first flange portion 122 through a mechanical coupling member.

An O-ring 166 can be provided between the discharge cover assembly 180 and the frame 120 to prevent the refrigerant in a gasket 165 for thermal insulation and the discharge space 104 from leaking.

The discharge cover assembly 180 can be formed of a thermally conductive material. Therefore, when a high temperature refrigerant is introduced into the discharge cover assembly 180, heat of the refrigerant can be transferred to the casing 110 through the discharge cover assembly 180 and dissipated to the outside of the compressor.

The discharge cover assembly 180 can include one discharge cover, or can be arranged so that a plurality of discharge covers sequentially communicate with each other. When the discharge cover assembly 180 is provided with the plurality of discharge covers, the discharge space 104 can include a plurality of spaces partitioned by the respective discharge covers. The plurality of spaces can be disposed in a front-rear direction and can communicate with each other.

For example, when there are three discharge covers, the discharge space 104 can include a first discharge space 104*a* between the frame 120 and a first discharge cover 181 coupled to the front side of the frame 120, a second discharge space 104*b* between the first discharge cover 181 and a second discharge cover 182 that communicates with the first discharge space 104*a* and is coupled to a front side of the first discharge cover 181, and a third discharge space 104*c* between the second discharge cover 182 and a third discharge cover 183 that communicates with the second discharge space 104*b* and is coupled to a front side of the second discharge cover 182.

The first discharge space 104*a* can selectively communicate with the compression space 103 by the discharge valve 171, the second discharge space 104*b* can communicate with the first discharge space 104*a*, and the third discharge space 104*c* can communicate with the second discharge space 104*b*. Hence, as the refrigerant discharged from the compression space 103 sequentially passes through the first discharge space 104*a*, the second discharge space 104*b*, and the third discharge space 104*c*, a discharge noise can be reduced, and the refrigerant can be discharged to the outside of the casing 110 through the loop pipe 115*a* and the discharge pipe 115 communicating with the third discharge cover 183.

The drive unit 130 can include the outer stator 131 that is disposed between the shell 111 and the frame 120 and surrounds the body portion 121 of the frame 120, the inner stator 134 that is disposed between the outer stator 131 and the cylinder 140 and surrounds the cylinder 140, and the mover 135 disposed between the outer stator 131 and the inner stator 134.

The outer stator 131 can be coupled to the rear of the first flange portion 122 of the frame 120, and the inner stator 134 can be coupled to the outer circumferential surface of the body portion 121 of the frame 120. The inner stator 134 can be spaced apart from the inside of the outer stator 131, and the mover 135 can be disposed in a space between the outer stator 131 and the inner stator 134.

The outer stator 131 can be equipped with a winding coil, and the mover 135 can include a permanent magnet. The permanent magnet can be comprised of a single magnet with one pole or configured by combining a plurality of magnets with three poles.

The outer stator 131 can include a coil winding body 132 surrounding the axial direction in the circumferential direction, and a stator core 133 stacked while surrounding the coil winding body 132. The coil winding body 132 can include a hollow cylindrical bobbin 132*a* and a coil 132*b* wound in a circumferential direction of the bobbin 132*a*. A cross section of the coil 132*b* can be formed in a circular or polygonal shape and, for example, can have a hexagonal shape. In the stator core 133, a plurality of lamination sheets can be laminated radially, or a plurality of lamination blocks can be laminated along the circumferential direction.

The front side of the outer stator 131 can be supported by the first flange portion 122 of the frame 120, and the rear side thereof can be supported by a stator cover 137. For example, the stator cover 137 can be provided in a hollow disc shape, a front surface of the stator cover 137 can be supported by the outer stator 131, and a rear surface thereof can be supported by a resonant spring 118.

The inner stator 134 can be configured by stacking a plurality of laminations on the outer circumferential surface of the body portion 121 of the frame 120 in the circumferential direction.

One side of the mover 135 can be coupled to and supported by the magnet frame 136. The magnet frame 136 has a substantially cylindrical shape and can be disposed to be inserted into a space between the outer stator 131 and the inner stator 134. The magnet frame 136 can be coupled to the rear side of the piston 150 to move together with the piston 150.

As an example, a rear end of the magnet frame 136 is bent and extended inward in the radial direction to form a first coupling portion 136*a*, and the first coupling portion 136*a* can be coupled to a third flange portion 153 formed behind the piston 150. The first coupling portion 136*a* of the magnet frame 136 and the third flange portion 153 of the piston 150 can be coupled through a mechanical coupling member.

A fourth flange portion 161*a* formed in front of the first intake muffler 161 and a fifth flange portion 162*a* formed in rear of the inner guide 162 can be interposed between the third flange portion 153 of the piston 150 and the first coupling portion 136*a* of the magnet frame 136. Thus, the piston 150, the first muffler unit 160, and the mover 135 can linearly reciprocate together in a combined state.

When a current is applied to the drive unit 130, a magnetic flux can be formed in the winding coil, and an electromagnetic force can occur by an interaction between the magnetic flux formed in the winding coil of the outer stator 131 and a magnetic flux formed by the permanent magnet of the mover 135 to move the mover 135. At the same time as the reciprocating movement of the mover 135 in the axial direction, the piston 150 connected to the magnet frame 136 can also reciprocate integrally with the mover 135 in the axial direction.

The drive unit 130 and the compression units 140 and 150 can be supported by the support springs 116 and 117 and the resonant spring 118 in the axial direction.

The resonant spring 118 amplifies the vibration implemented by the reciprocating motion of the mover 135 and the piston 150 and thus can achieve an effective compression of the refrigerant. More specifically, the resonant spring 118 can be adjusted to a frequency corresponding to a natural frequency of the piston 150 and can allow the piston 150 to perform a resonant motion. Further, the resonant spring 118 generates a stable movement of the piston 150 and thus can reduce the generation of vibration and noise.

The resonant spring 118 can be a coil spring extending in the axial direction. Both ends of the resonant spring 118 can be connected to a vibrating body and a fixed body, respectively. For example, one end of the resonant spring 118 can be connected to the magnet frame 136, and the other end can be connected to the back cover 123. Therefore, the resonant spring 118 can be elastically deformed between the vibrating body vibrating at one end and the fixed body fixed to the other end.

A natural frequency of the resonant spring 118 can be designed to match a resonant frequency of the mover 135 and the piston 150 during the operation of the compressor 100, thereby amplifying the reciprocating motion of the piston 150. However, because the back cover 123 provided as the fixing body is elastically supported by the first support spring 116 in the casing 110, the back cover 123 may not be strictly fixed.

The resonant spring 118 can include a first resonant spring 118*a* supported on the rear side and a second resonant spring 118*b* supported on the front side based on a spring supporter 119.

The spring supporter 119 can include a body portion 119*a* surrounding the first intake muffler 161, a second coupling portion 119*b* that is bent from a front of the body portion 119*a* in the inward radial direction, and a support portion 119*c* that is bent from the rear of the body portion 119*a* in the outward radial direction.

A front surface of the second coupling portion 119*b* of the spring supporter 119 can be supported by the first coupling portion 136*a* of the magnet frame 136. The second coupling portion 119*b* of the spring supporter 119 can be coupled to the piston 150. An inner diameter of the second coupling portion 119*b* of the spring supporter 119 can cover an outer diameter of the first intake muffler 161. For example, the second coupling portion 119*b* of the spring supporter 119, the first coupling portion 136*a* of the magnet frame 136, and the third flange portion 153 of the piston 150 can be sequentially disposed and then integrally coupled through a mechanical member. In this instance, the description, that the fourth flange portion 161*a* and the fifth flange portion 162*a* of the first intake muffler 161 can be interposed between the third flange portion 153 of the piston 150 and the first coupling portion 136*a* of the magnet frame 136 and they can be fixed together, is the same as that described above.

The first resonant spring 118*a* can be disposed between a front surface of the back cover 123 and a rear surface of the spring supporter 119. The second resonant spring 118*b* can be disposed between a rear surface of the stator cover 137 and a front surface of the spring supporter 119.

A plurality of first and second resonant springs 118*a* and 118*b* can be disposed in the circumferential direction of the central axis. The first resonant springs 118*a* and the second resonant springs 118*b* can be disposed parallel to each other in the axial direction, or can be alternately disposed. The first and second resonant springs 118*a* and 118*b* can be disposed at regular intervals in the radial direction of the central axis. For example, three first resonant springs 118*a* and three second resonant springs 118*b* can be provided and can be disposed at intervals of 120 degrees in the radial direction of the central axis.

The compressor 100 can include a plurality of sealing members that can increase a coupling force between the frame 120 and the components around the frame 120.

For example, the plurality of sealing members can include a first sealing member that is interposed at a portion where the frame 120 and the discharge cover assembly 180 are coupled and is inserted into an installation groove provided at the front end of the frame 120, and a second sealing member that is provided at a portion at which the frame 120 and the cylinder 140 are coupled and is inserted into an installation groove provided at an outer surface of the cylinder 140. The second sealing member can prevent the refrigerant of the gas groove 125*c* between the inner circumferential surface of the frame 120 and the outer circumferential surface of the cylinder 140 from leaking to the outside, and can increase a coupling force between the frame 120 and the cylinder 140. The plurality of sealing members can further include a third sealing member that is provided at a portion at which the frame 120 and the inner stator 134 are coupled and is inserted into an installation groove provided at the outer surface of the frame 120. In some examples, the first to third sealing members can have a ring shape.

An operation of the linear compressor 100 described above is as follows.

First, when a current is applied to the drive unit 130, a magnetic flux can be formed in the outer stator 131 by the current flowing in the coil 132*b*. The magnetic flux formed in the outer stator 131 can generate an electromagnetic force, and the mover 135 including the permanent magnet can linearly reciprocate by the generated electromagnetic force. The electromagnetic force can be alternately generated in a direction (forward direction) in which the piston 150 is directed toward a top dead center (TDC) during a compression stroke, and in a direction (rearward direction) in which the piston 150 is directed toward a bottom dead center (BDC) during an intake stroke. That is, the drive unit 130 can generate a thrust which is a force for pushing the mover 135 and the piston 150 in a moving direction.

The piston 150 linearly reciprocating inside the cylinder 140 can repeatedly increase or reduce the volume of the compression space 103.

When the piston 150 moves in a direction (rearward direction) of increasing the volume of the compression space 103, a pressure of the compression space 103 can decrease. Hence, the intake valve 155 mounted in front of the piston 150 is opened, and the refrigerant remaining in the intake space 102 can be suctioned into the compression space 103 along the intake port 154. The intake stroke can be performed until the piston 150 is positioned in the bottom dead center by maximally increasing the volume of the compression space 103.

The piston 150 reaching the bottom dead center can perform the compression stroke while switching its motion direction and moving in a direction (forward direction) of reducing the volume of the compression space 103. As the pressure of the compression space 103 increases during the compression stroke, the suctioned refrigerant can be compressed. When the pressure of the compression space 103 reaches a setting pressure, the discharge valve 171 is pushed out by the pressure of the compression space 103 and is opened from the cylinder 140, and the refrigerant can be discharged into the discharge space 104 through a separation space. The compression stroke can continue while the piston 150 moves to the top dead center at which the volume of the compression space 103 is minimized.

As the intake stroke and the compression stroke of the piston 150 are repeated, the refrigerant introduced into the accommodation space 101 inside the compressor 100 through the intake pipe 114 can be introduced into the intake space 102 in the piston 150 by sequentially passing the intake guide 116*a*, the first intake muffler 161, and the inner guide 162, and the refrigerant of the intake space 102 can be introduced into the compression space 103 in the cylinder 140 during the intake stroke of the piston 150. After the refrigerant of the compression space 103 is compressed and discharged into the discharge space 104 during the compression stroke of the piston 150, the refrigerant can be discharged to the outside of the compressor 100 via the loop pipe 115*a* and the discharge pipe 115.

Figure 3:
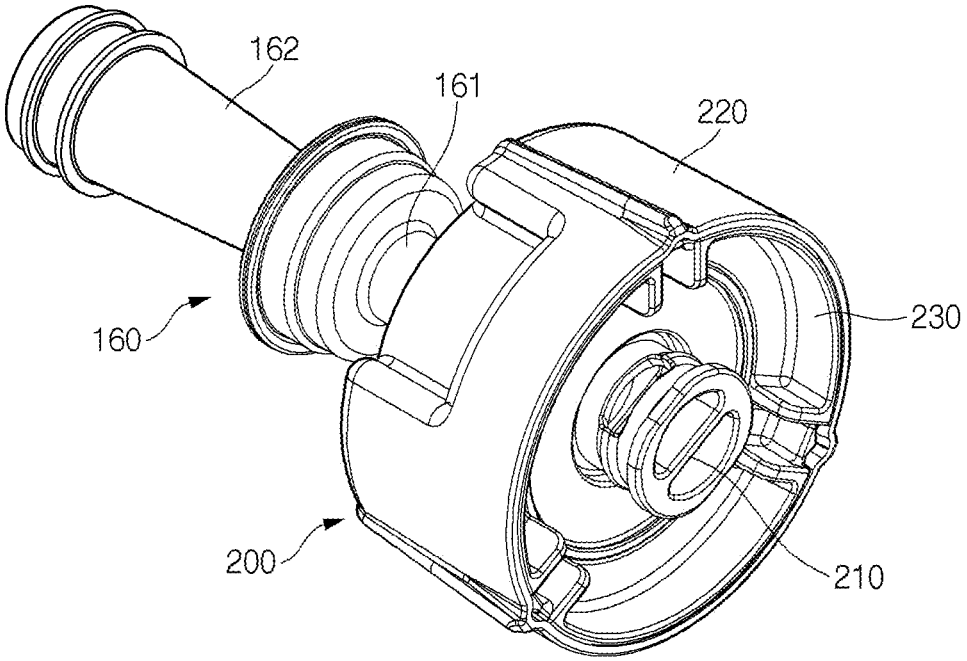
FIGS. 3 and 4 are a perspective view showing an example of a muffler unit.
Figure 4:
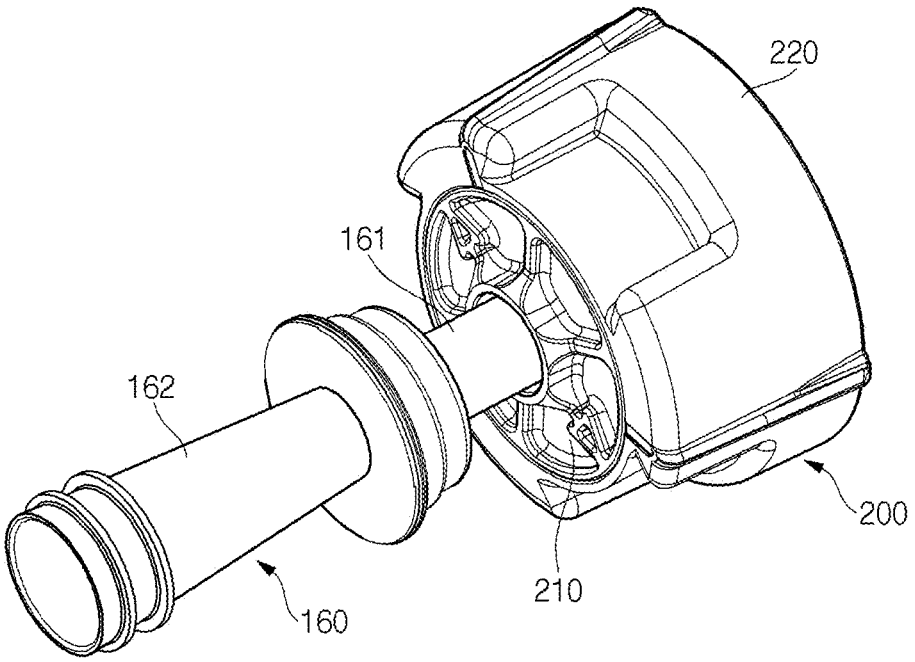
Figure 5:
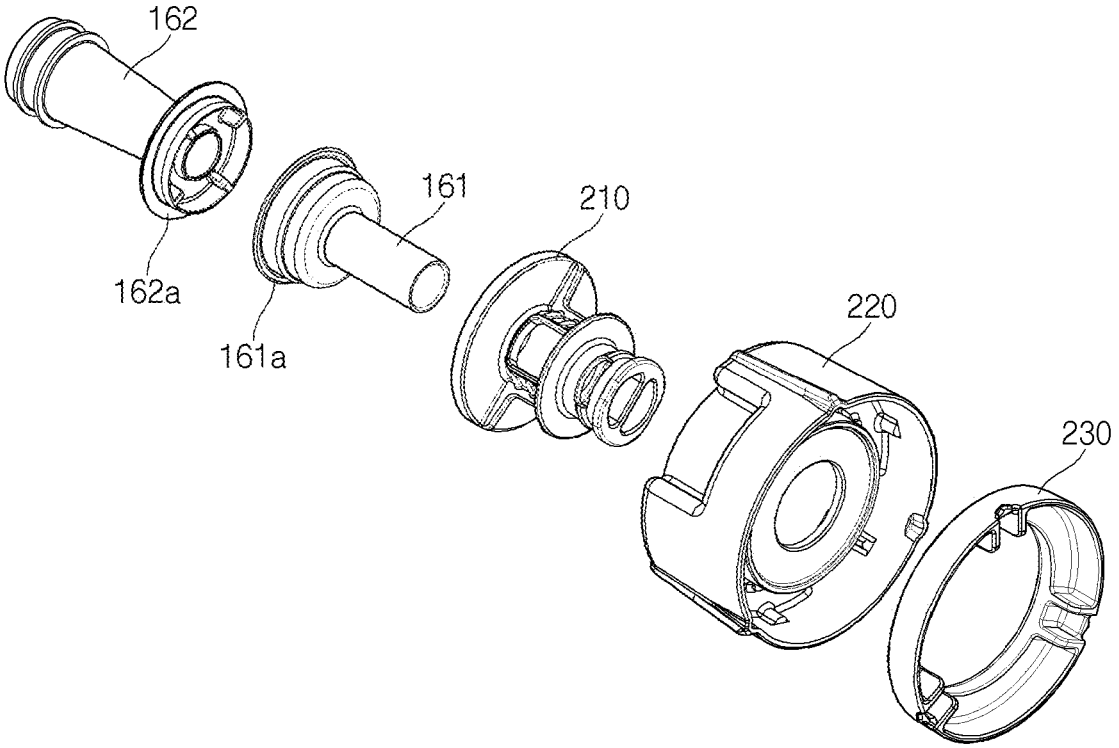
FIG. 5 is an exploded perspective view showing the muffler unit.
Figure 6:
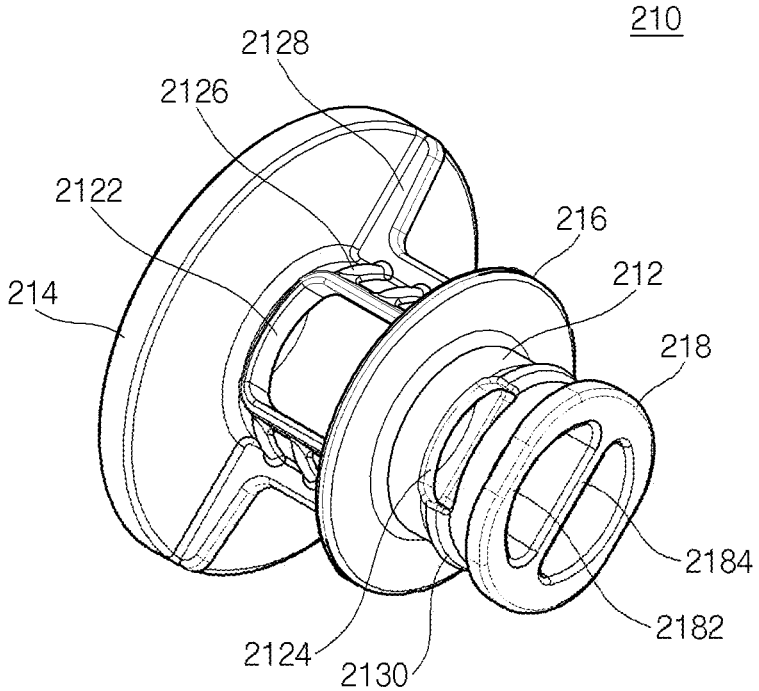
FIG. 6 is a perspective view showing an example of a second intake muffler.
Figure 7:
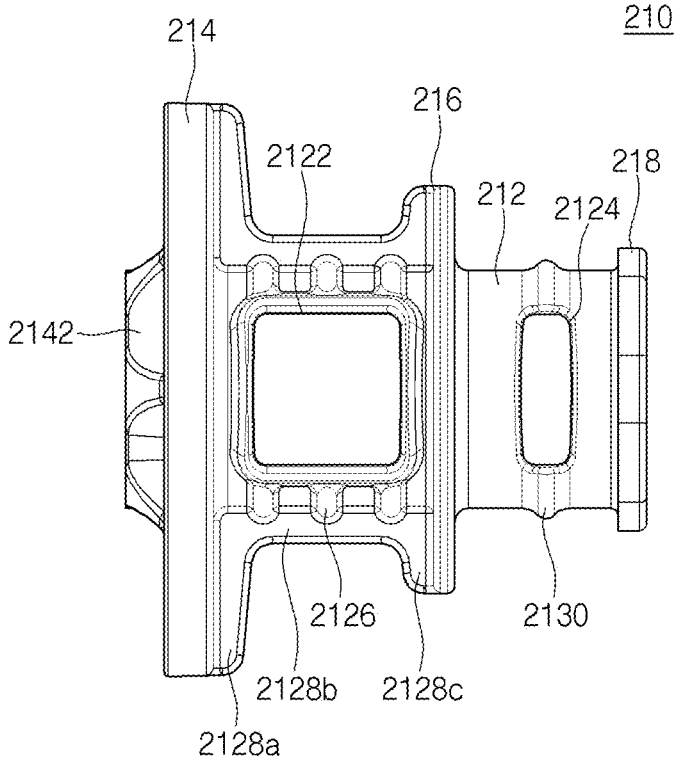
FIG. 7 is a side view showing the second intake muffler.
Figure 8:
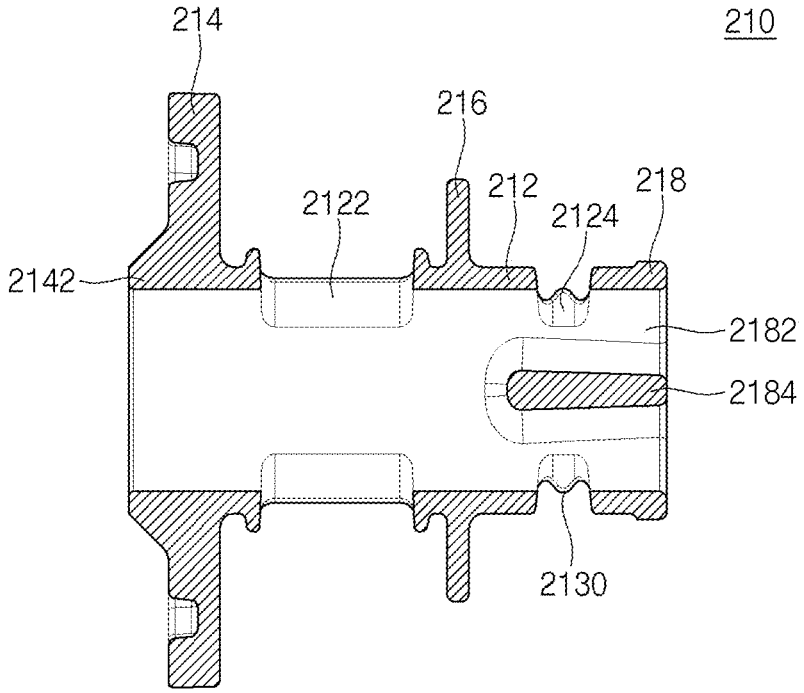
FIG. 8 is a cross-sectional view the second intake muffler.
Figure 9:
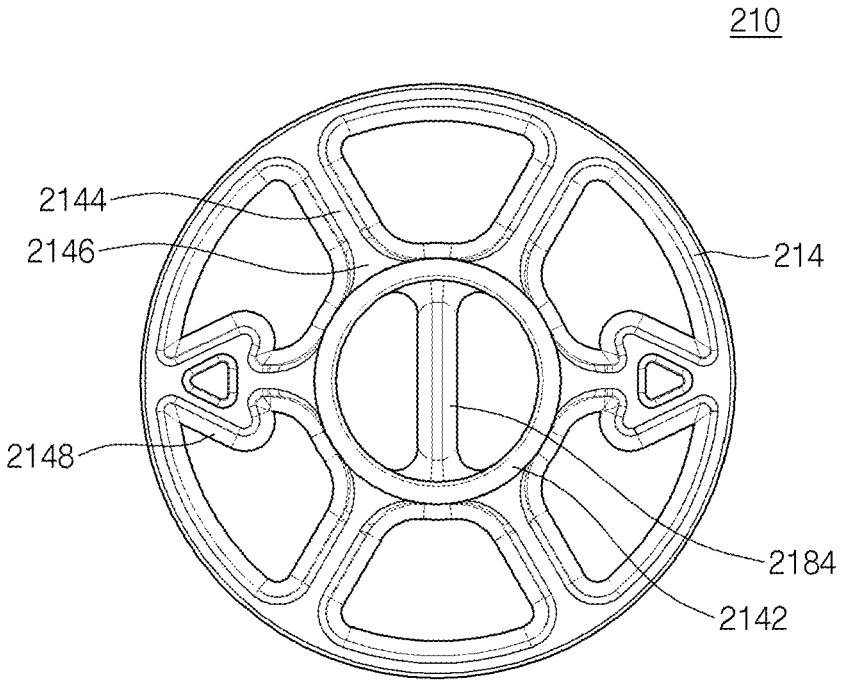
FIG. 9 is a front view showing the second intake muffler.
Figure 10:
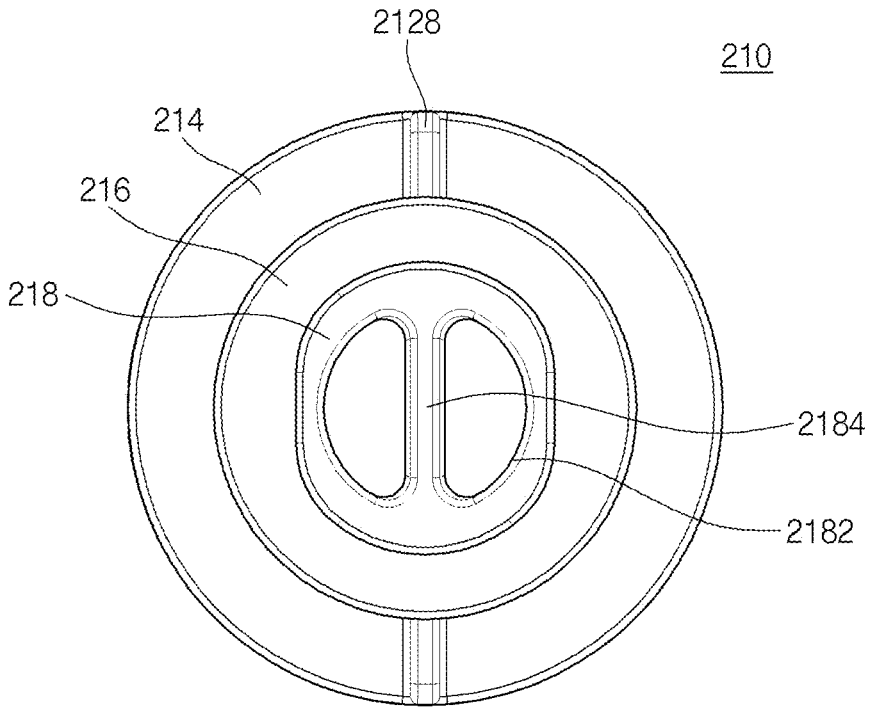
FIG. 10 is a rear view showing the second intake muffler.
Figure 11:
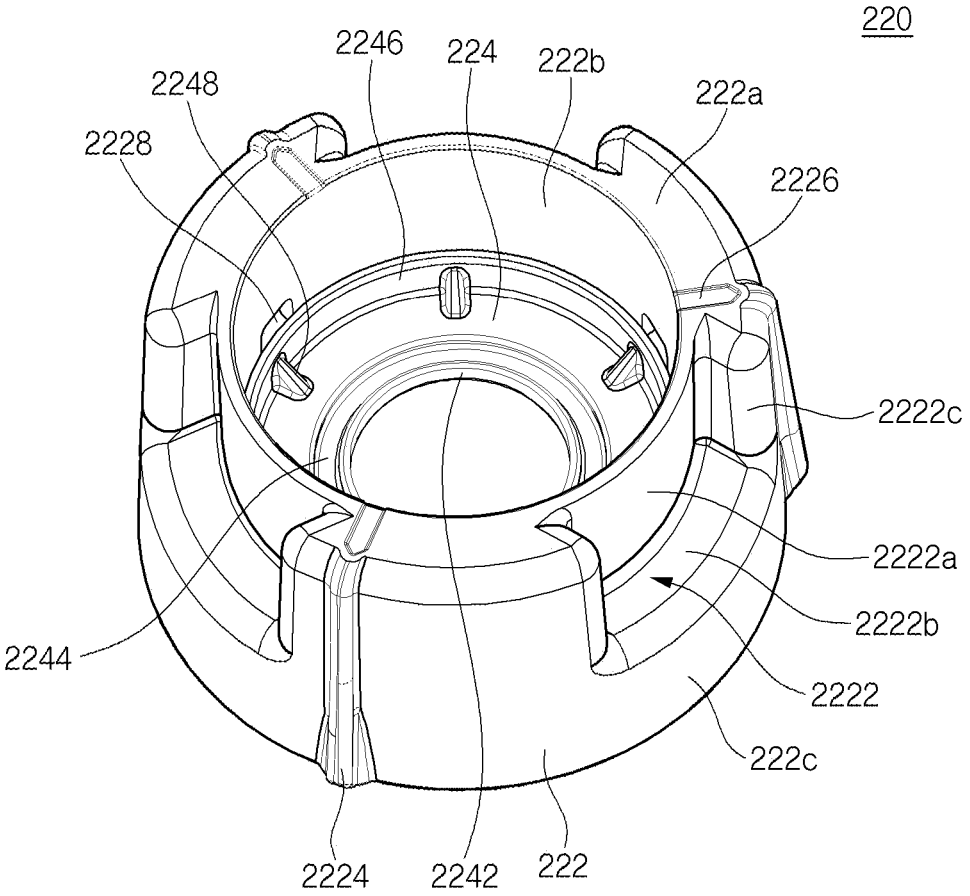
FIGS. 11 and 12 are a perspective view showing an example of a muffler body.
Figure 12:
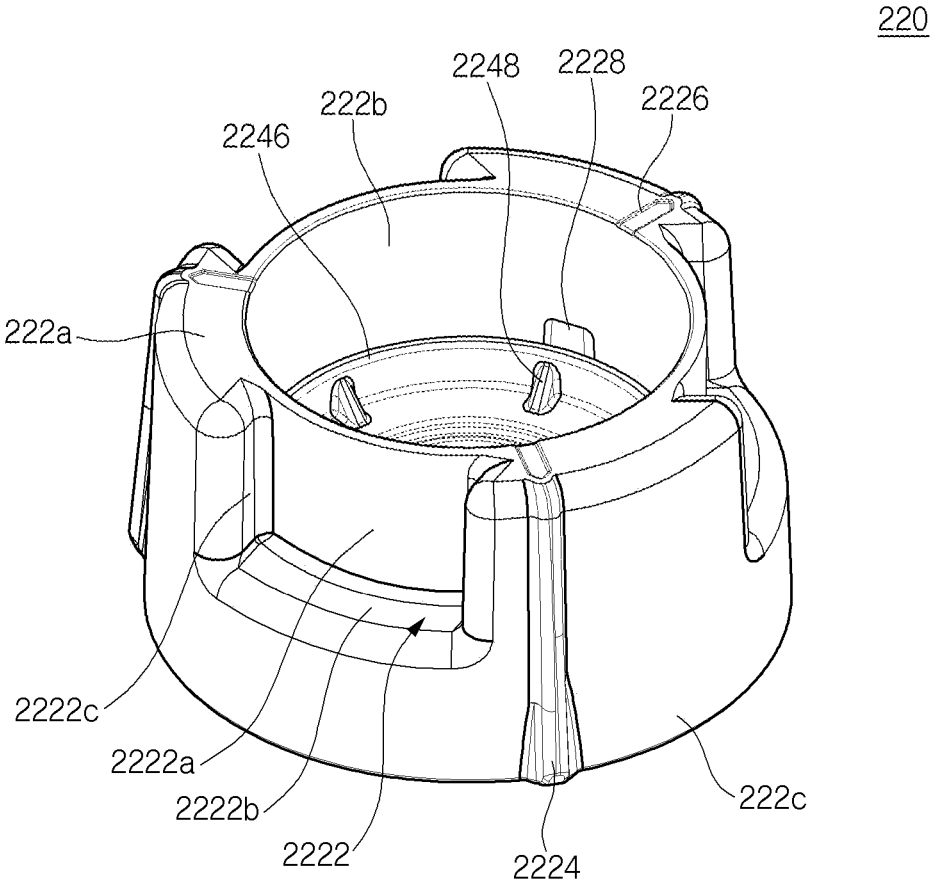
Figure 13:
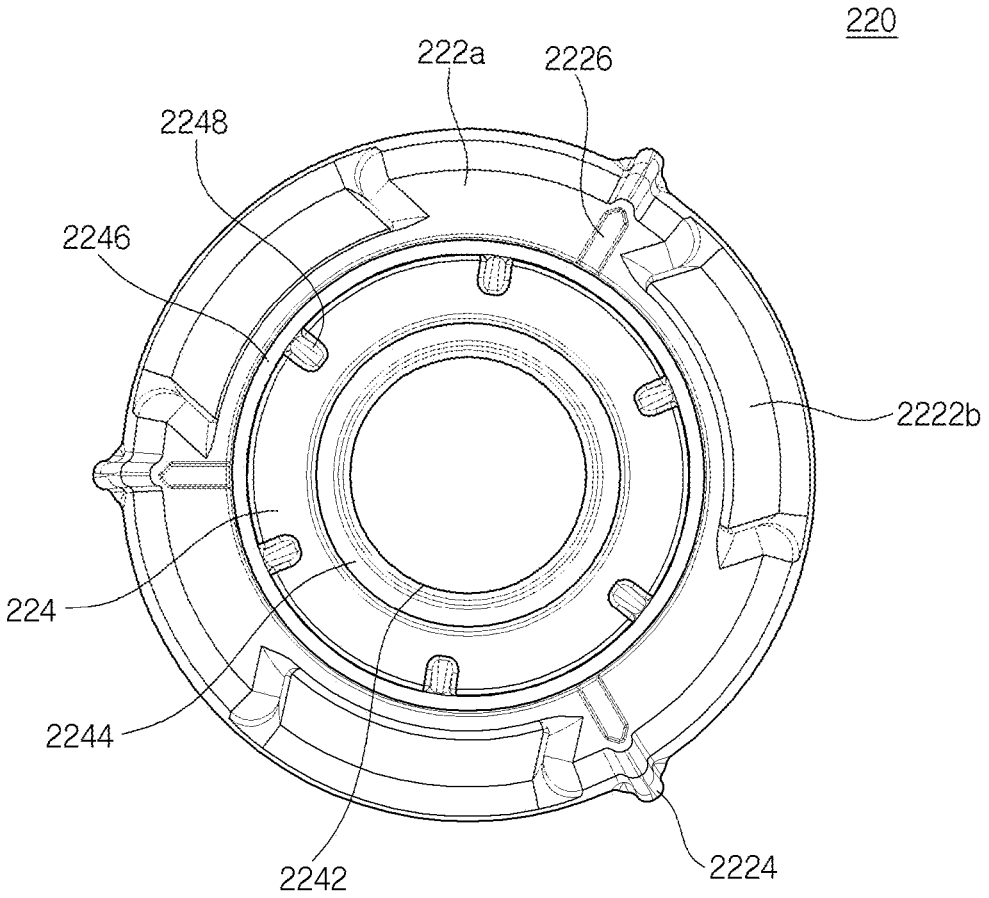
FIG. 13 is a front view showing the muffler body.
Figure 14:
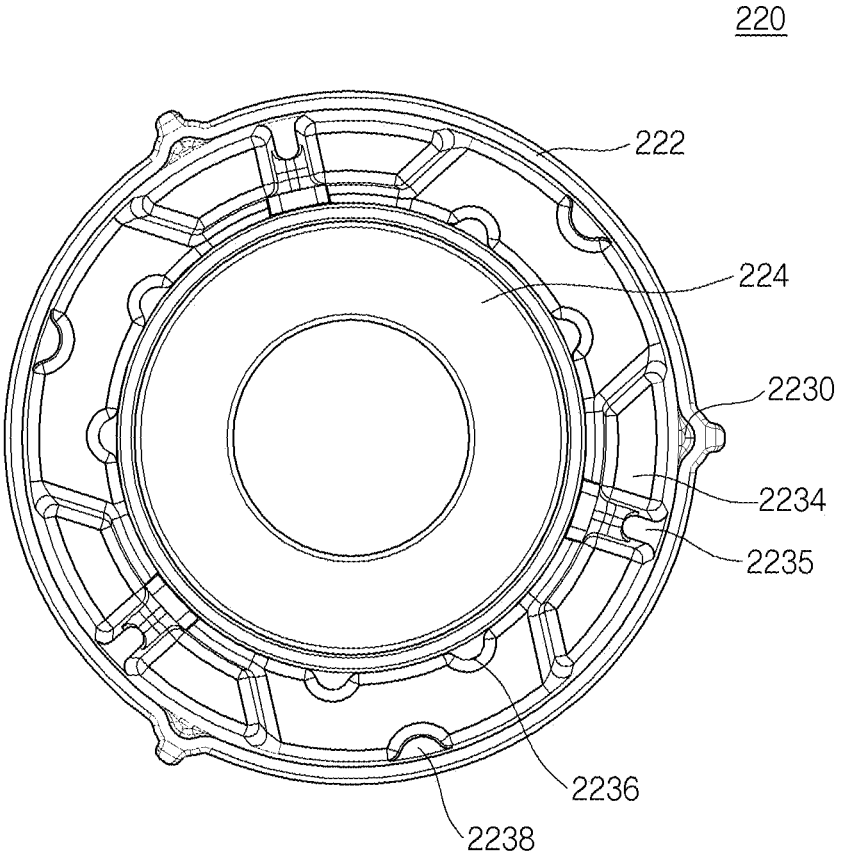
FIG. 14 is a rear view showing the muffler body.
Figure 15:
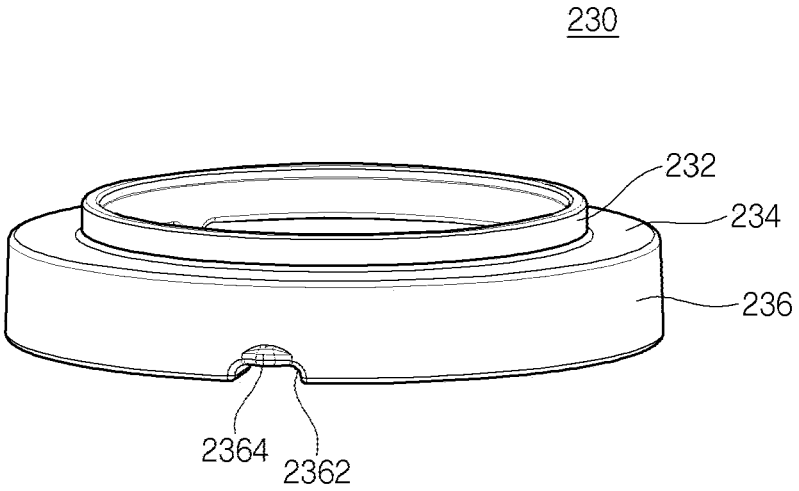
FIGS. 15 and 16 are a perspective view showing an example of a muffler cover.
Figure 16:
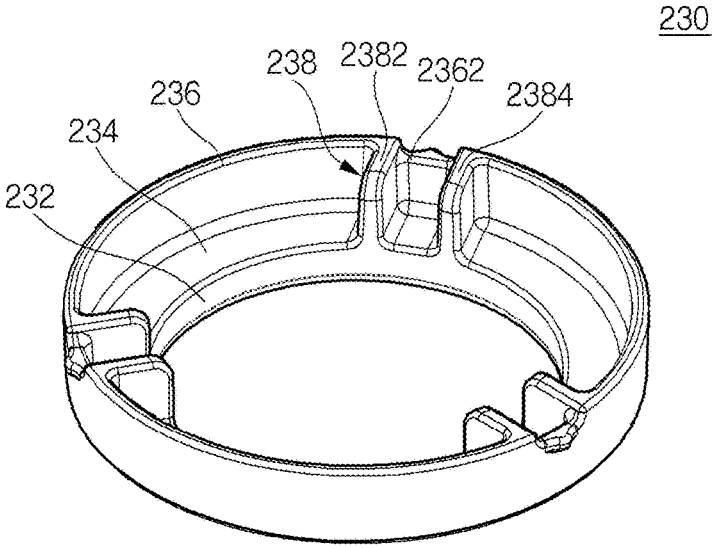
Figure 17:
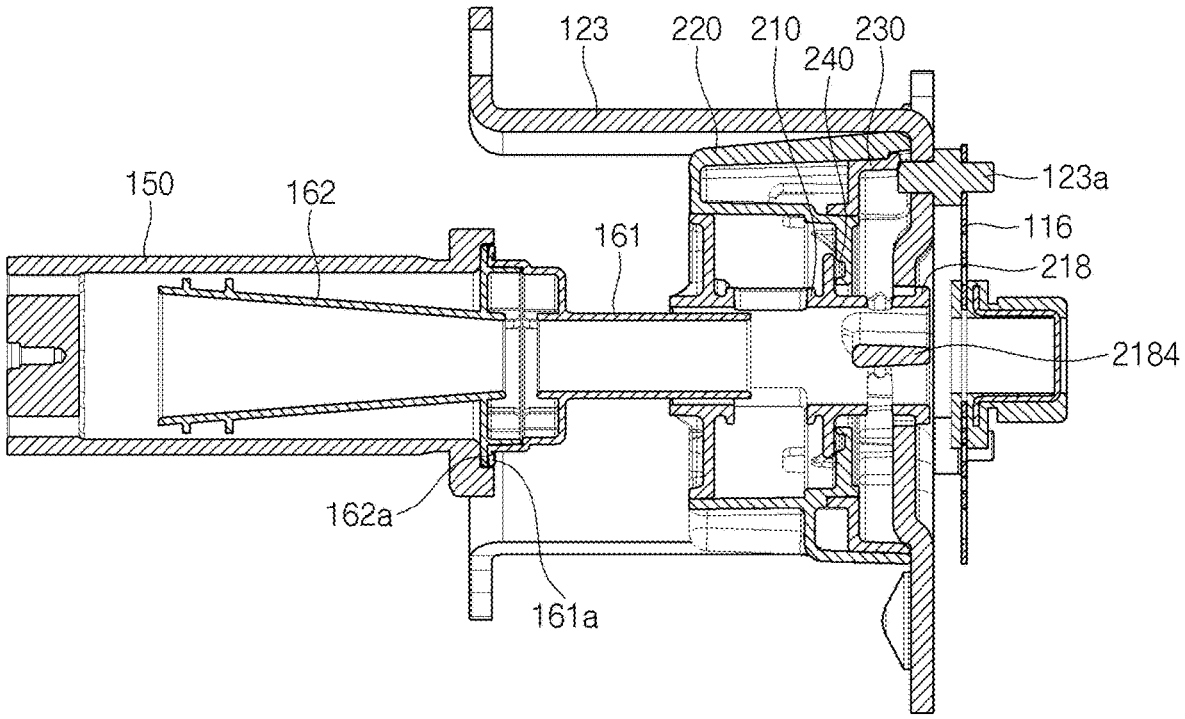
FIG. 17 is a cross-sectional view showing an example of a piston, a muffler unit, and a back cover.
Figure 18:
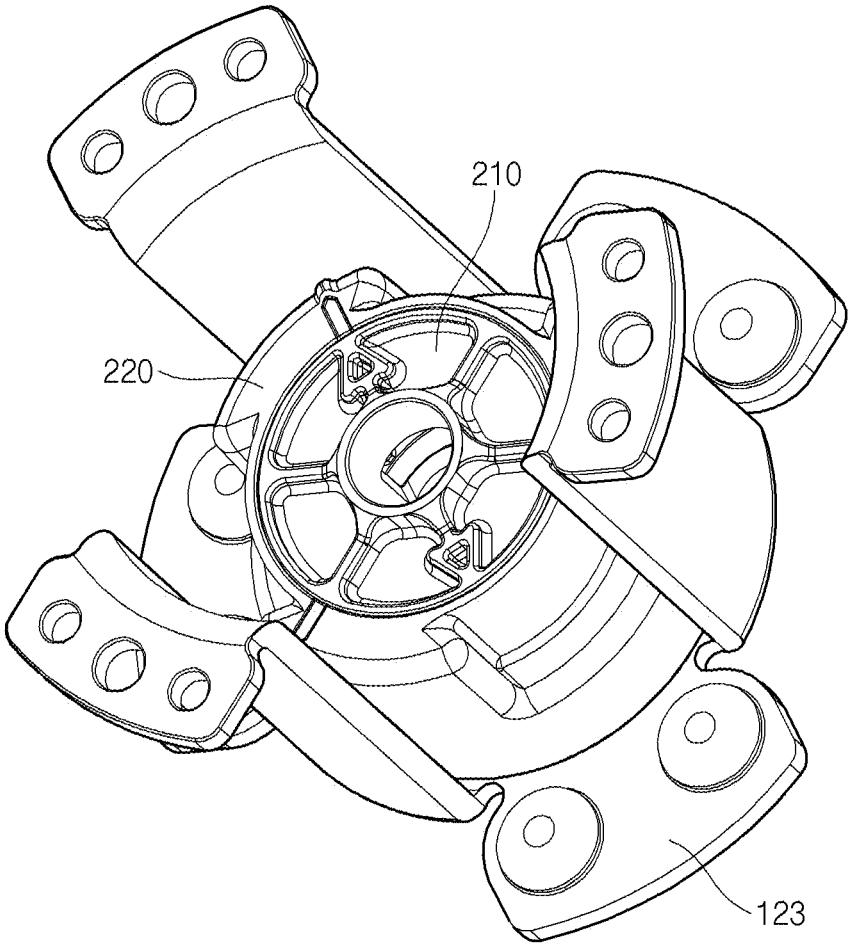
FIG. 18 is a perspective view showing the muffler unit and the back cover.
Figure 19:
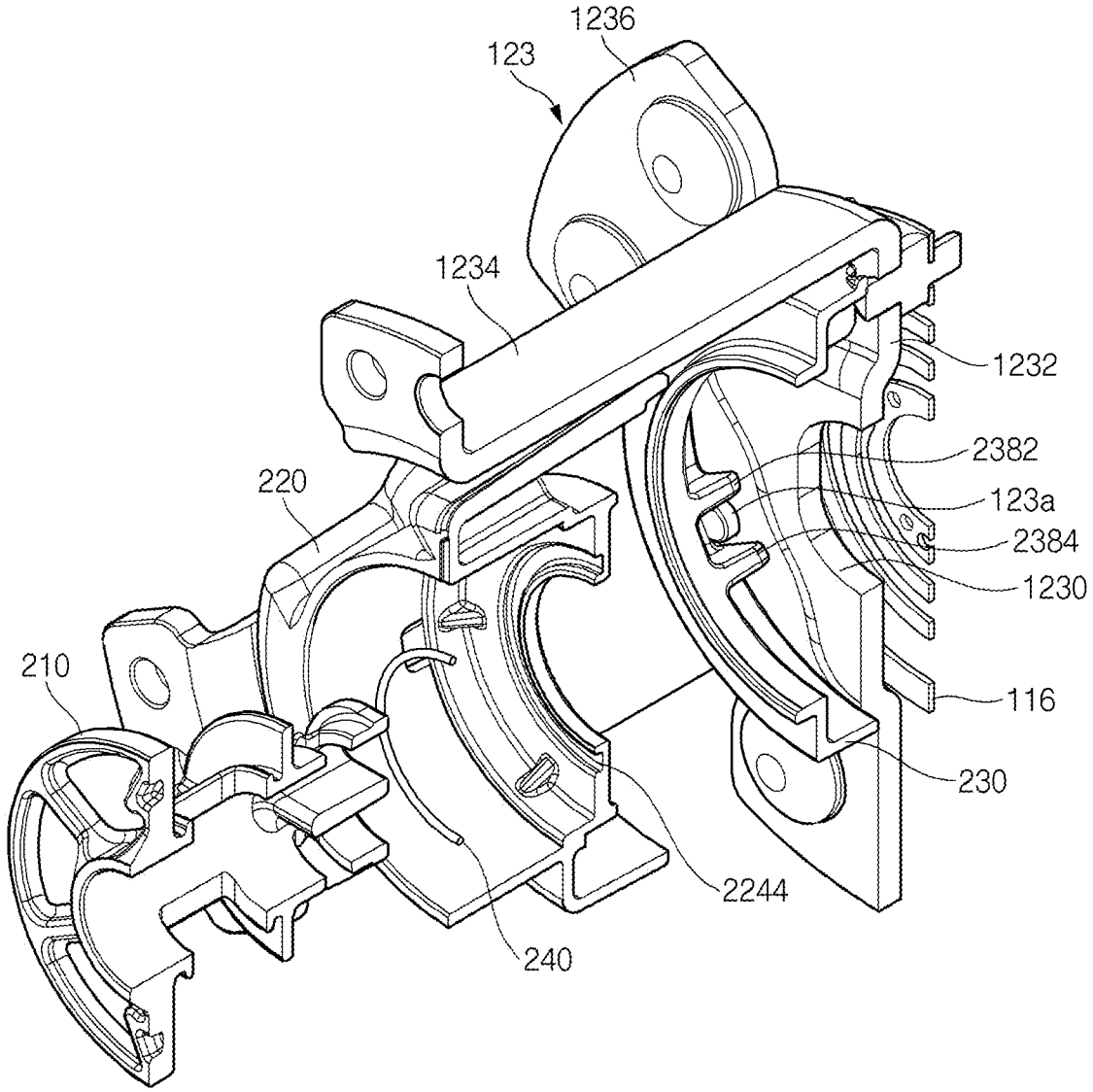
FIG. 19 is a cross-sectional exploded perspective view showing the muffler unit and the back cover.
Figure 20:
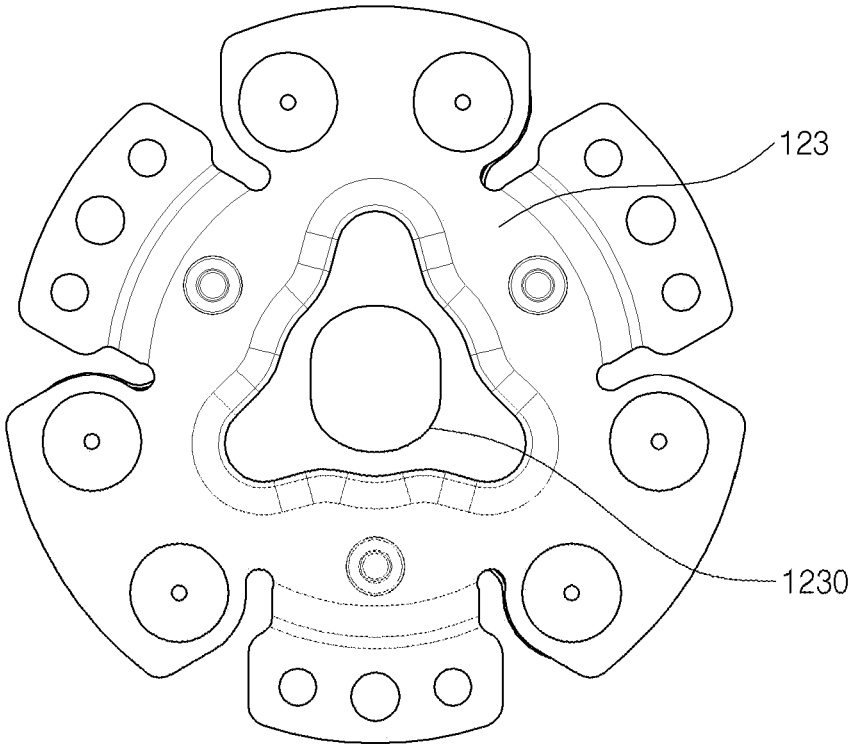
FIG. 20 is a rear view showing the back cover.
Figure 21:
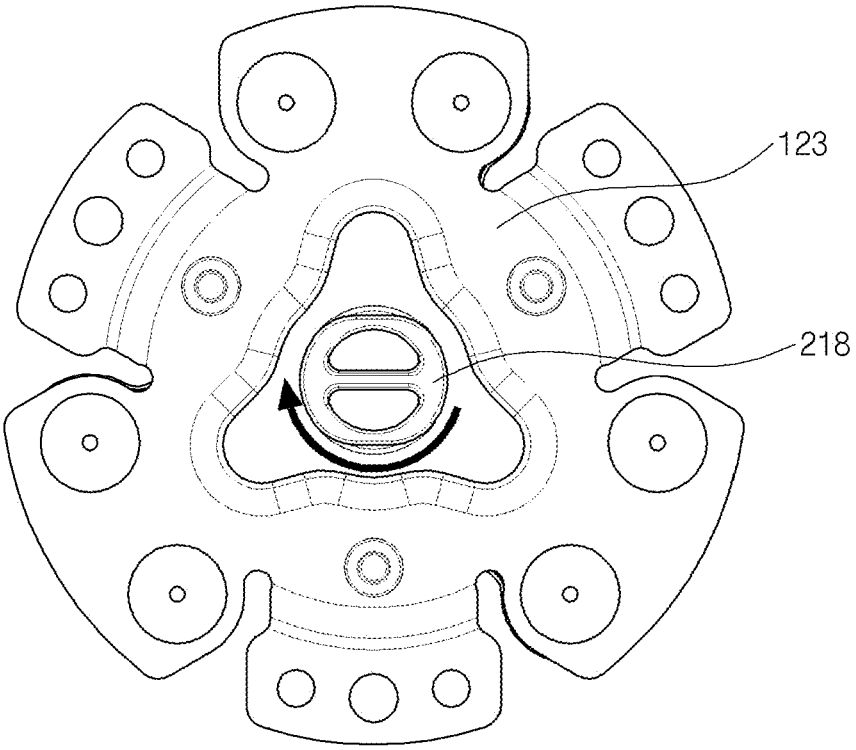
FIGS. 21 and 22 are a rear view showing the back cover and the muffler unit.
Figure 22:
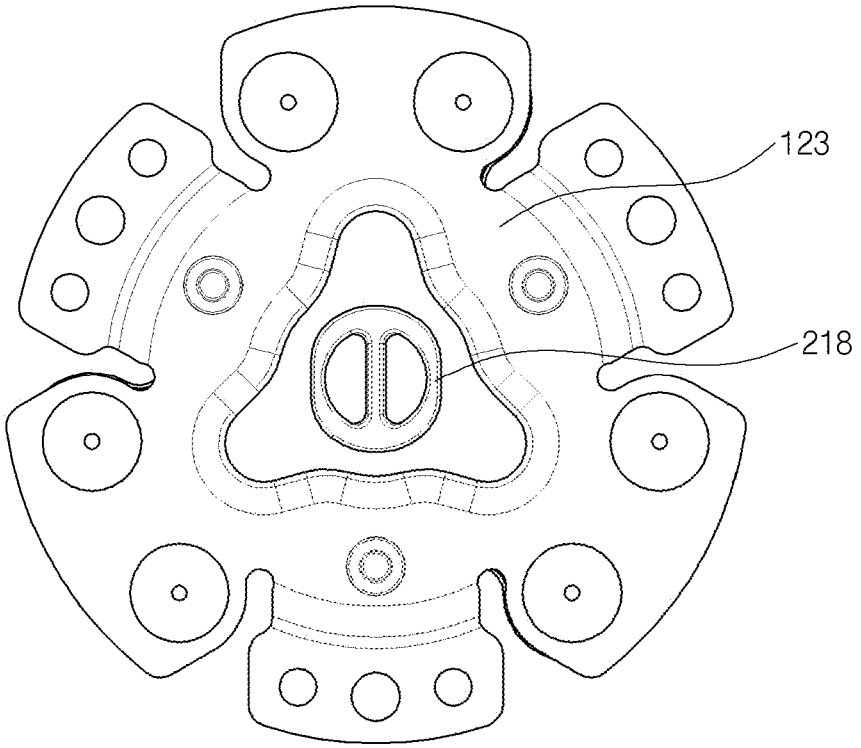
Figure 23:
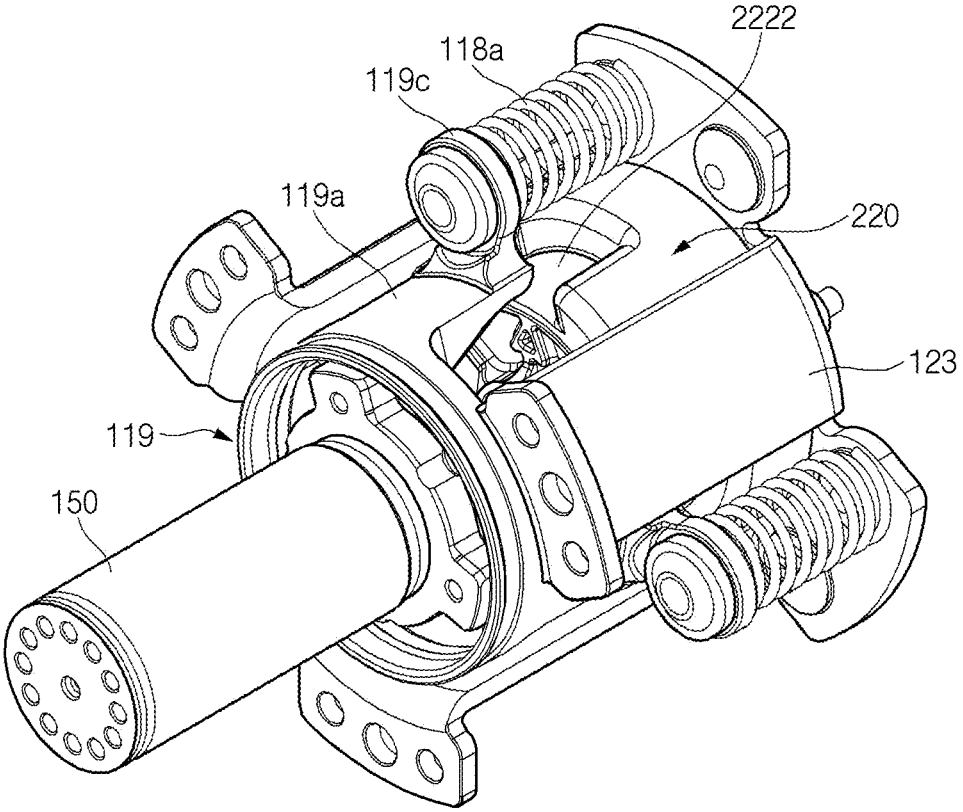
FIG. 23 is a perspective view showing an example of the piston, a spring supporter, a first resonant spring, the muffler unit, and the back cover.
Figure 24:
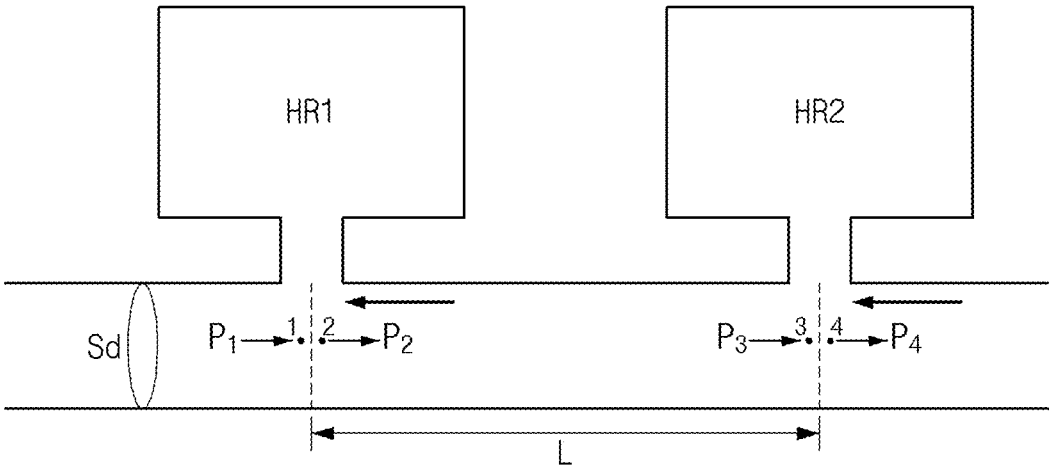
FIG. 24 is a block diagram showing an example of multiple resonators.
Figure 25:
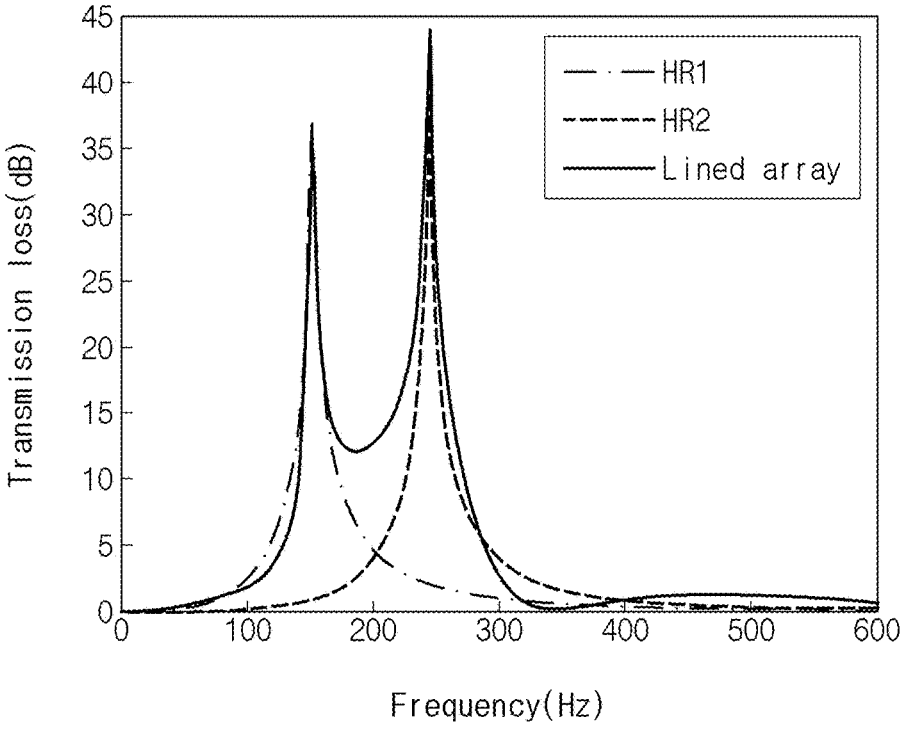
FIG. 25 is a graph illustrating an example of a transmission loss (TL) per frequency in multiple resonators.
Figure 26:
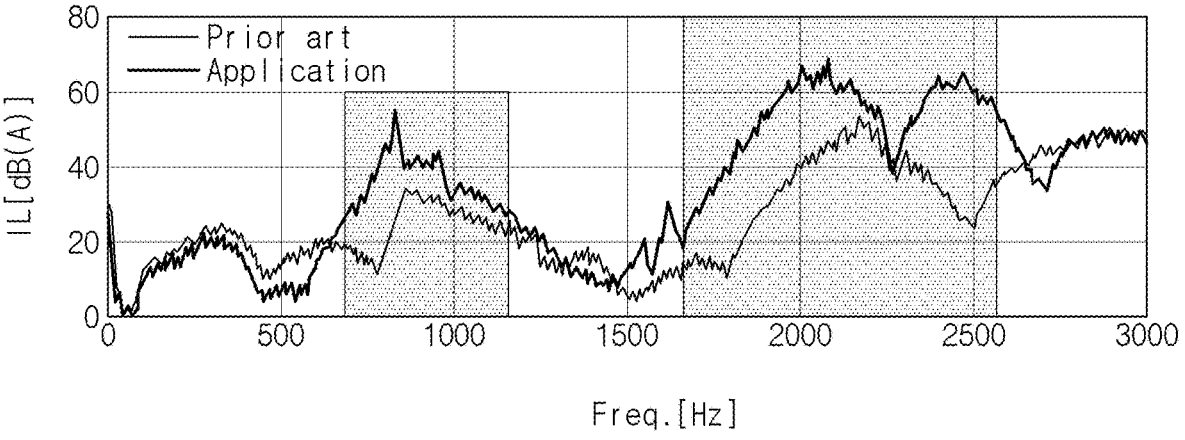
FIG. 26 is a graph illustrating an example of an insertion loss (IL) depending on a frequency in a muffler unit according to a related art and a muffler unit.

FIGS. 3 and 4 are a perspective view showing an example of a muffler unit. FIG. 5 is an exploded perspective view of the muffler unit. FIG. 6 is a perspective view showing an example of a second intake muffler. FIG. 7 is a side view of the second intake muffler. FIG. 8 is a cross-sectional view of the second intake muffler. FIG. 9 is a front view of the second intake muffler. FIG. 10 is a rear view of the second intake muffler. FIGS. 11 and 12 are a perspective view showing an example of a muffler body. FIG. 13 is a front view of the muffler body. FIG. 14 is a rear view of the muffler body. FIGS. 15 and 16 are a perspective view showing an example of a muffler cover. FIG. 17 is a cross-sectional view showing an example of a piston, a muffler unit, and a back cover. FIG. 18 is a perspective view of the muffler unit and the back cover. FIG. 19 is a cross-sectional exploded perspective view of the muffler unit and the back cover. FIG. 20 is a rear view of the back cover. FIGS. 21 and 22 are a rear view of the back cover and the muffler unit. FIG. 23 is a perspective view showing an example of the piston, a spring supporter, a first resonant spring, the muffler unit, and the back cover. FIG. 24 is a block diagram showing an example of multiple resonators. FIG. 25 is a graph illustrating an example of a transmission loss (TL) per frequency in multiple resonators. FIG. 26 is a graph illustrating an example of an insertion loss (IL) depending on a frequency in a muffler unit according to a related art and a muffler unit.

Referring to FIGS. 3 to 23, muffler units 160 and 200 of the linear compressor 100 can include a first muffler unit 160 and a second muffler unit 200, but can be implemented except some of these components and does not exclude additional components.

In the present disclosure, the front refers to an axially front and the rear refers to an axially rear. More specifically, in FIG. 2, the front can refer to a downward direction, and the rear can refer to an upward direction. In FIG. 17, the front can refer to a left direction, and the rear can refer to a right direction. For example, the refrigerant in the cylinder is compressed in a direction from a rear side of the cylinder to a front side of the cylinder.

In some implementations, the first muffler unit 160 can include the first intake muffler 161 and the inner guide 162.

The second muffler unit 200 can be coupled to an opening 1230 formed in a radially central area of the back cover 123. The second muffler unit 200 can provide an expansion space in which noise is attenuated between the piston 150 and the back cover 123. Through this, noise of the linear compressor 100 can be reduced by improving a performance of the muffler units 160 and 200.

The second muffler unit 200 can include ribs 2126, 2130, 2128, 2144, 2148, 2224, 2248, 2236, 2238, and 2235 protruding from an outer surface or an inner surface. It can be understood here that the outer surface includes a radially outer circumferential surface, a front surface, and a rear surface. Through this, the rigidity of the second muffler unit 200 can be improved.

The second muffler unit 200 can include a second intake muffler 210, a muffler body 220, and a muffler cover 230, but can be implemented except some of these components and does not exclude additional components.

The second intake muffler 210 can communicate with the first intake muffler 161. A diameter of a front end of the second intake muffler 210 can be larger than a diameter of a rear end of the first intake muffler 161. As the piston 150 reciprocates axially, a rear area of the first intake muffler 161 coupled to the piston 150 can move axially inside the second intake muffler 210.

The second intake muffler 210 can be coupled to the back cover 123. More specifically, the second intake muffler 210 can be coupled to the opening 1230.

The second intake muffler 210 can include a first cylindrical portion 212. The first cylindrical portion 212 can be formed in a cylindrical shape in which both the front and the rear are opened. A first communication hole 2122 can be formed in an outer circumferential surface of the first cylindrical portion 212. The front of the first cylindrical portion 212 can communicate with the first intake muffler 161. A diameter of a front end of the first cylindrical portion 212 can be larger than the diameter of the rear end of the first intake muffler 161. The first intake muffler 161 can be positioned inside the front end of the first cylindrical portion 212. The first cylindrical portion 212 can be coupled to the back cover 123.

In the first cylindrical portion 212, a first flange 214, a second flange 216, a third coupling portion 218, first ribs 2126 and 2130, and a first communication hole 2122, a second rib 2128, a second communication hole 2124, a partition wall 2184, a protrusion 2142, and third ribs 2144 and 2148 can be formed.

The second intake muffler 210 can include the first flange 214. The first flange 214 can extend radially outward from the front of the first cylindrical portion 212. The first flange 214 can radially overlap a front end of the muffler body 220. The protrusion 2142 disposed adjacent to an internal flow path and protruding forward can be formed on a front surface of the first flange 214. A radially protruding length of the first flange 214 can be greater than a radially protruding length of the second flange 216.

The second intake muffler 210 can include the second flange 216. The second flange 216 can extend radially outward from a central area of the first cylindrical portion 212. The second flange 216 can be disposed between the first flange 214 and the third coupling portion 218. The second flange 216 can contact a third flange 224 of the muffler body 220. Specifically, a rear surface of the second flange 216 can contact a front surface of the third flange 224 of the muffler body 220. An elastic member 240 can be disposed between the second flange 216 and the third flange 224. The drawings illustrate that a third groove 2244 is formed only in the third flange 224, by way of example. However, unlike this, a groove in which the elastic member 240 is disposed can also be formed in the second flange 216.

The second intake muffler 210 can include the third coupling portion 218. The third coupling portion 218 can be formed at the rear of the second intake muffler 210. The third coupling portion 218 can protrude radially outward from the rear end of the first cylindrical portion 212. The third coupling portion 218 can be formed in a shape corresponding to the opening 1230 of the back cover 123. The third coupling portion 218 can pass through the opening 1230 of the back cover 123, rotate, and be seated on the rear surface of the back cover 123. In this case, the third coupling portion 218 and the opening 1230 of the back cover 123 can be formed in an oval or polygonal shape.

Through this, it is possible to firmly couple the back cover 123 made of a metal material and the second muffler unit 200 made of a non-metal material. In addition, the second intake muffler 210 can be coupled to the opening 1230 of the back cover 123 without a separate welding process.

The second intake muffler 210 can include the first communication hole 2122 formed in its outer circumferential surface. The first communication hole 2122 can be formed in the first cylindrical portion 212. The first communication hole 2122 can be formed between the first flange 214 and the second flange 216. The first communication hole 2122 can communicate an inside of the second intake muffler 210 with a space between the second intake muffler 210 and the muffler body 220. The space between the second intake muffler 210 and the muffler body 220 in which the first communication hole 2122 is formed can be referred to as a "first expansion space." The first communication hole 2122 can include a plurality of first communication holes 2122 that are spaced apart in a circumferential direction. Through this, the present disclosure can improve noise filtering characteristics through an additional expansion room of the second muffler unit 200.

In some implementations, the first communication hole 2122 is described as having a rectangular shape by way of example, but the shape of the first communication hole 2122 can be variously changed.

The space between the second intake muffler 210 and the muffler body 220 may not axially overlap the first intake muffler 161. Only a part of the space between the second intake muffler 210 and the muffler body 220 can axially overlap the piston 150. Through this, the present disclosure can improve space efficiency while improving noise filtering characteristics of the muffler units 160 and 200.

The second intake muffler 210 can include the second communication hole 2124 formed in its outer circumferential surface. The second communication hole 2124 can be formed in the first cylindrical portion 212. The second communication hole 2124 can be formed between the second flange 216 and the third coupling portion 218. The second communication hole 2124 can communicate the inside of the second intake muffler 210 with a space between the second intake muffler 210, the muffler body 220, the muffler cover 230, and the back cover 123. The space between the second intake muffler 210, the muffler body 220, the muffler cover 230, and the back cover 123 can be referred to as a "second expansion space." The second communication hole 2124 can include a plurality of second communication holes 2124 that are spaced apart in a circumferential direction. Through this, the present disclosure can improve noise filtering characteristics through an additional expansion room of the second muffler unit 200.

In some implementations, the second communication hole 2124 is described as having a rectangular shape by way of example, but the shape of the second communication hole 2124 can be variously changed.

A diameter of the space between the second intake muffler 210, the muffler body 220, the muffler cover 230, and the back cover 123 can be greater than a diameter of the space between the second intake muffler 210 and the muffler body 220. Through this, the present disclosure can improve noise reduction efficiency of the second muffler unit.

The second intake muffler 210 can include the partition wall 2184. The partition wall 2184 can partition an inner space 2182 of the first cylindrical portion 212. The partition wall 2184 can be formed only in a rear area of the first cylindrical portion 212. The partition wall 2184 can radially overlap the second communication hole 2124. The partition wall 2184 can radially overlap the space between the second intake muffler 210, the muffler body 220, the muffler cover 230, and the back cover 123. Through this, the present disclosure can improve the space efficiency while improving the intake efficiency of the refrigerant.

The second intake muffler 210 can include the first ribs 2126 and 2130. The first ribs 2126 and 2130 can protrude radially outward from the outer circumferential surface of the second intake muffler 210. The first ribs 2126 and 2130 can protrude radially outward from the outer circumferential surface of the first cylindrical portion 212. The first ribs 2126 and 2130 can extend in the circumferential direction. A part of the first ribs 2126 and 2130 can be disposed between the first flange 214 and the second flange 216, and other part can be disposed between the second flange 216 and the third coupling portion 218.

A part of the first ribs 2126 and 2130 can overlap the first communication hole 2122 in the circumferential direction. Through this, the present disclosure can improve the rigidity of the second intake muffler 210 without affecting the flow of the refrigerant flowing inside the second intake muffler 210.

The first ribs 2126 and 2130 can include a plurality of first ribs 2126 and 2130 that are axially spaced apart from each other. In some implementations, the plurality of first ribs 2126 and 2130 can be configured such that the three first ribs are disposed between the first flange 214 and the second flange 216, and the two first ribs are disposed between the second flange 216 and the third coupling portion 218, by way of example. However, the present disclosure is not limited thereto, and the number of first ribs 2126 and 2130 can be variously changed.

The second intake muffler 210 can include the second rib 2128. The second rib 2128 can extend axially between the first flange 214 and the second flange 216. The second rib 2128 can include a first area 2128*b* extending axially from the outer circumferential surface of the first cylindrical portion 212; a second area 2128*a* that is connected to the first area 2128*b*, protrudes rearward from the rear surface of the first flange 214, and extends radially; and a third area 2128*c* that is connected to the first area 2128*b*, protrudes forward from the front surface of the second flange 216, and extends radially.

The second rib 2128 can overlap a part (e.g., 2126) of the first ribs 2126 and 2130. A radially protruding length of the second rib 2128 can be greater than radially protruding lengths of the first ribs 2126 and 2130.

Through this, the present disclosure can prepare for vibration applied to the second intake muffler 210 by improving the rigidity of the second intake muffler 210 in a plurality of directions.

The second intake muffler 210 can include the third ribs 2144 and 2148. The third ribs 2144 and 2148 can be formed on the first flange 214. The third ribs 2144 and 2148 can protrude forward from the front surface of the first flange 214. The third ribs 2144 and 2148 can protrude radially. Through this, the rigidity of the first flange 214 can be improved.

The third ribs 2144 and 2148 can include a plurality of third ribs 2144 and 2148 spaced apart in the circumferential direction. The plurality of third ribs 2144 and 2148 can be radially disposed based on a central area of the first flange 214. A part (e.g., 2144) of the plurality of third ribs 2144 and 2148 can be formed in a different shape from a shape of other part (e.g., 2148). Through this, the coupling direction of the second intake muffler 210 including the first flange 214 can be guided.

The third ribs 2144 and 2148 may not axially overlap the second rib 2128. Through this, the present disclosure can improve the space efficiency while improving the rigidity of the second intake muffler 210.

An area where the third ribs 2144 and 2148 and the protrusion 2142 are connected can be formed as a curved surface 2146.

The muffler body 220 can surround the second intake muffler 210. When the second intake muffler 210 is coupled to the opening 1230, the muffler body 220 can be press-fitted to the back cover 123. The muffler body 220 can include a second cylindrical portion 222 and the third flange 224.

The second cylindrical portion 222 can be disposed at a radially outside of the second intake muffler 210. The second cylindrical portion 222 can be formed in a cylindrical shape with an opened rear. Specifically, the second cylindrical portion 222 can have a shape in which a front and a rear of a central area are opened, a front of a space between an inner surface 222*b* and an outer surface 222*c* is closed, and a rear of the space between the inner surface 222*b* and the outer surface 222*c* is opened.

The third flange 224 can extend inward from the inner surface 222*b* of the second cylindrical portion 222. An inner area of the third flange 224 can axially overlap an outer area of the second flange 216. The third flange 224 can contact the second flange 216. Specifically, the front surface of the third flange 224 can contact the rear surface of the second flange 216. Through this, when the third coupling portion 218 of the second intake muffler 210 is coupled to the opening 1230 of the back cover 123, the muffler body 220 can be press-fitted between the second intake muffler 210 and the back cover 123.

The elastic member 240 can be disposed between the third flange 224 and the second flange 216. The third flange 224 can include the third groove 2244 in which the elastic member 240 is seated. The present disclosure describes that the third groove 2244 is formed only in the third flange 224, by way of example, but the third groove 2244 can be formed in at least one of the front surface of the third flange 224 and the rear surface of the second flange 216. The third groove 2244 can extend in the circumferential direction. Through this, the present disclosure can guide a position of the elastic member 240 disposed between the second intake muffler 210 and the muffler body 220, and can improve the coupling stability by allowing the second muffler unit 200 to be press-fitted to the back cover 123 while removing a gap between the second intake muffler 210 and the muffler body 220.

A hole 2242 can be formed in the central area of the third flange 224. The first cylindrical portion 212 of the second intake muffler 210 can be disposed in the hole 2242.

The muffler body 220 can include a resonance communication hole 2228. The resonance communication hole 2228 can be formed in the inner surface 222*b* of the second cylindrical portion 222. The resonance communication hole 2228 can communicate a space between the second intake muffler 210 and the second cylindrical portion 222 with a space between the muffler body 220 and the muffler cover 230. The resonance communication hole 2228 can communicate a space between the second intake muffler 210 and the second cylindrical portion 222 with a space between the second cylindrical portion 222 and a ring portion 234.

The resonance communication hole 2228 can be disposed adjacent to the third flange 224. Through this, noise generated in the piston 150 can be easily introduced into the resonator via the resonance communication hole 2228.

The space between the second cylindrical portion 222 and the ring portion 234 can be understood as a space between the inner surface 222*b*, the outer surface 222*c*, and a front surface 222*a* of the second cylindrical portion 222 and the ring portion 234. The space between the second cylindrical portion 222 and the ring portion 234 can be referred to as a "resonator."

The resonator that is the space between the inner surface 222*b*, the outer surface 222*c*, and the front surface 222*a* of the second cylindrical portion 222 and the ring portion 234 can form a closed space by the second cylindrical portion 222 and the ring portion 234 except for the resonance communication hole 2228.

An axial length of the space between the muffler body 220 and the muffler cover 230 can be greater than a radial length of the space between the muffler body 220 and the muffler cover 230. The space between the muffler body 220 and the muffler cover 230 may not axially overlap the piston 150.

Due to the additional resonator, it is possible to reduce noise of a low frequency or mid-frequency in the 1.25 kHz frequency band.

The muffler body 220 can include a fourth rib 2224. The fourth rib 2224 can protrude radially outward from the outer surface 222*c* or the outer circumferential surface of the second cylindrical portion 222. The fourth rib 2224 can extend axially. Through this, the rigidity of the muffler body 220 can be improved.

The fourth rib 2224 can contact a leg portion 1234 of the back cover 123. The back cover 123 can include a support member 1232 in which the opening 1230 is formed, a plurality of leg portions 1234 that extend forward from a radially outside of the support member 1232 and are spaced apart in the circumferential direction, and a plurality of extension members 1236 that extend radially from the support member 1232 and are spaced apart in the circumferential direction. The fourth rib 2224 can include a plurality of fourth ribs 2224 spaced apart in the circumferential direction. Each of the plurality of fourth ribs 2224 can contact each of the plurality of leg portions 1234. Through this, the present disclosure can guide the position of the muffler body 220 relative to the back cover 123 and press-fit the muffler body 220 to the back cover 123.

The muffler body 220 can include a fifth rib 2248. The fifth rib 2248 can be formed in an area between the inner surface 222*b* of the second cylindrical portion 222 and the front surface of the third flange 224. Specifically, the fifth rib 2248 can extend from the inner surface 222*b* of the second cylindrical portion 222 to the front surface of the third flange 224. Through this, the rigidity of the area connecting the second cylindrical portion 222 and the third flange 224 can be improved.

The fifth rib 2248 can be closer to the inner surface 222*b* of the second cylindrical portion 222 as the fifth rib 2248 becomes distant from the front surface of the third flange 224. Specifically, as the fifth rib 2248 becomes distant from the front surface of the third flange 224, a length of the fifth rib 2248 from the inner surface 222*b* of the second cylindrical portion 222 can decrease. Through this, the position of the second flange 216 relative to the third flange 224 can be guided.

The muffler body 220 can include a plurality of first grooves 2222. The plurality of first grooves 2222 can be concave inward from the outer surface 222*c* of the second cylindrical portion 222. The plurality of first grooves 2222 can be concavely formed rearward from the front surface 222*a* of the second cylindrical portion 222. The plurality of first grooves 2222 can be spaced apart from each other in the circumferential direction. In some implementations three first grooves 2222 may be defined, by way of example, but other implementations are not limited thereto. For example, the number of first grooves 2222 can be variously changed.

The first groove 2222 can include a base surface 2222*a*, a first stepped portion 2222*b* that connects the base surface 2222*a* and the outer surface 222*c* of the second cylindrical portion 222 and extends in the circumferential direction, and second and third stepped portions 2222*c* that connect the base surface 2222*a* and the outer surface 222*c* of the second cylindrical portion 222 and extend axially.

The plurality of first grooves 2222 can axially overlap the support portion 119*c* of the spring supporter 119. Through this, the present disclosure can prevent interference between the muffler body 220 and the spring supporter 119 and improve the space efficiency.

A resonator can be formed between the plurality of first grooves 2222 in the circumferential direction. Specifically, a space between the muffler body 220 and the muffler cover 230 can be formed between the plurality of first grooves 2222 in the circumferential direction. More specifically, the space between the inner surface 222*b*, the outer surface 222*c*, and the front surface 222*a* of the second cylindrical portion 222 and the ring portion 234 can be formed each between the plurality of first grooves 2222 in the circumferential direction. The plurality of resonance communication holes 2228 can be disposed between the plurality of first grooves 2222 in the circumferential direction. Through this, it is possible to improve space efficiency while preventing interference with other configurations.

The muffler body 220 can include sixth ribs 2236 and 2238. The sixth ribs 2236 and 2238 can extend rearward from a rear surface of the first stepped portion 2222*b* of the first groove 2222. Through this, the rigidity of the plurality of first grooves 2222 can be improved.

The sixth ribs 2236 and 2238 can include an inner rib 2236 formed at the inside and an outer rib 2238 disposed at a radially outside of the inner rib 2236. An axial length of the outer rib 2238 can be greater than an axial length of the inner rib 2236. Specifically, a protruding length of the outer rib 2238 from the first stepped portion 2222*b* can be greater than a protruding length of the inner rib 2236. Through this, the position of the muffler cover 230 relative to the muffler body 220 can be guided.

The muffler cover 230 can be seated on the sixth ribs 2236 and 2238. The ring portion 234 can be seated on the outer rib 2238, and a second extension 232 can be seated on the inner rib 2236.

The muffler body 220 can include a guide groove 2226. The guide groove 2226 can be formed in the front surface 222*a* of the second cylindrical portion 222. The guide groove 2226 can include a plurality of guide grooves 2226 spaced apart in the circumferential direction. The guide groove 2226 can radially overlap the fourth rib 2224. Through this, when the second muffler unit 200 is coupled to the back cover 123, a correct coupling direction can be guided to a user.

An area 2234 which is opened rearward between the inner surface 222*b* and the outer surface 222*c* in the muffler body 220 can be referred to as a "resonator." The area 2234 which is opened rearward between the inner surface 222*b* and the outer surface 222*c* in the muffler body 220 can be sealed by the muffler cover 230. That is, this can be understood as the same meaning as the space between the muffler body 220 and the muffler cover 230.

The muffler body 220 can include an eighth rib 2235. The eighth rib 2235 can be formed in the area 2234 which is opened rearward between the inner surface 222*b* and the outer surface 222*c* in the muffler body 220. The eighth rib 2235 can be formed in a space between the plurality of first grooves 2222. Specifically, the eighth rib 2235 can be formed in a space between the second and third stepped portions 2222*c*. The eighth rib 2235 can protrude inward from the outer surface 222*c* of the muffler body 220. Through this, it is possible to improve the rigidity of the resonator of the muffler body 220 while improving the space efficiency.

The muffler cover 230 can be disposed between the muffler body 220 and the back cover 123. The muffler cover 230 can be seated on the sixth ribs 2236 and 2238. When the second intake muffler 210 is coupled to the opening 1230, the muffler cover 230 can be press-fitted to the back cover 123. The muffler cover 230 can be entirely formed in a ring shape or a circular band shape.

The muffler cover 230 can include the ring portion 234, a first extension 236, and the second extension 232. The central area of the ring portion 234 can be opened. The ring portion 234 can extend in the circumferential direction. The ring portion 234 can be formed in a ring shape or a circular band shape. The first extension 236 can extend rearward from the outer surface or the outer end of the ring portion 234. The second extension 232 can extend forward from the inner surface or the inner end of the ring portion 234.

The ring portion 234 and the second extension 232 can contact the muffler body 220. The second extension 232 can be seated on the inner rib 2236. The ring portion 234 can be seated on the outer rib 2238. The first extension 236 can contact the back cover 123. An outer surface of the first extension 236 and an inner surface of the second extension 232 can contact the second cylindrical portion 222. Through this, when the third coupling portion 218 of the second intake muffler 210 is coupled to the opening 1230 of the back cover 123, the muffler cover 230 can be press-fitted between the muffler body 220 and the back cover 123.

The ring portion 234 can seal a rear opened between the inner surface 222*b* and the outer surface 222*c* of the second cylindrical portion 222. The outer surface of the first extension 236 can contact the second cylindrical portion 222.

The muffler cover 230 can include a seventh rib 238. The seventh rib 238 can be formed between the rear surface of the ring portion 234 and the inner surface of the first extension 236. The seventh rib 238 can include a plurality of seventh rib units 2382 and 2384 spaced apart in the circumferential direction. The plurality of seventh rib units 2382 and 2384 can face each other. The support bracket 123*a* can be disposed between the plurality of seventh rib units 2382 and 2384. Through this, the present disclosure can guide the position of the muffler cover 230 and improve the rigidity of the muffler cover 230.

The muffler cover 230 can include a fourth coupling portion 2364. The fourth coupling portion 2364 can protrude radially outward from the first extension 236. A straight line extending the fourth coupling portion 2364 can be disposed between the plurality of seventh rib units 2382 and 2384. The fourth coupling portion 2364 can be seated in a second groove 2230 concavely formed from the inside to the outside of the fourth rib 2224. The fourth coupling portion 2364 can include a plurality of fourth coupling portions 2364 spaced apart in the circumferential direction. Through this, the present disclosure can guide the position of the muffler cover 230 relative to the muffler body 220 while improving the rigidity of the muffler cover 230 and the muffler body 220.

FIG. 24 is a block diagram of multiple resonators. A space between the inner guide 162 and the piston 150 can be described as a first resonator HR1, and an additional resonator that is the space between the second cylindrical portion 222 and the ring portion 234 can be described as a second resonator HR2.

Referring to FIG. 25, when only the first resonator HR1 is present, only the transmission loss in the 100 Hz band is improved, and when only the second resonator HR2 is present, only the transmission loss in the 250 Hz band is improved. Compared to this, when the first resonator HR1 and the second resonator HR2 are linearly arranged, the transmission loss in both the 100 Hz and 250 Hz bands can be improved, and the transmission loss in a frequency band (e.g., 200 Hz) between the respective resonators HR1 and HR2 can also be improved.

When the resonators HR1 and HR2 are applied to the linear compressor 100, the first resonator HR1 can improve the transmission loss in the 800 Hz band, the second resonator HR2 can improve the transmission loss in the 1.25 kHz band, and the resonators HR1 and HR2 can improve the transmission loss in the 800 Hz and 1.25 kHz bands.

Referring to FIG. 26, noise reduction characteristics of the muffler units 160 and 200 of the linear compressor 100 can be further improved compared to the related art. Specifically, noise in a low or mid-frequency band between 800 Hz and 1.2 kHz can be reduced, and noise in a high-frequency band between 2 kHz and 2.5 kHz can also be reduced. The insertion loss (IL) can be understood as expressing a difference in a sound level before and after mounting the muffler units 160 and 200 on a dB scale.

Some implementations or other implementations of the present disclosure described above are not exclusive or distinct from each other. Some implementations or other implementations of the present disclosure described above can be used together or combined in configuration or function.

For example, configuration "A" described in an implementation and/or the drawings and configuration "B" described in another implementation and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. A linear compressor comprising:

a cylinder;

a piston configured to axially reciprocate in the cylinder;

a back cover disposed at a rear of the piston, the back cover defining an opening at a central area thereof in a radial direction;

a first muffler unit coupled to the piston, the first muffler unit comprising (i) an inner guide disposed in the piston and (ii) a first intake muffler disposed between the inner guide and the back cover;

a second muffler unit comprising (i) a second intake muffler that is in fluid communication with the first intake muffler and is coupled to the opening and (ii) a muffler body that surrounds the second intake muffler, wherein an outer circumferential surface of the second intake muffler defines a first communication hole that fluidly communicates an inside of the second intake muffler with a first space that is defined radially between the second intake muffler and the muffler body, wherein the second intake muffler comprises:

a first cylindrical portion, a first flange that extends radially outward from a front portion of the first cylindrical portion and radially overlaps with a front end of the muffler body, a second flange that extends radially outward from a central area of the first cylindrical portion, and a coupling portion that extends radially outward from a rear area of the first cylindrical portion and is coupled to the opening, wherein the muffler body comprises a second cylindrical portion disposed radially outside the second intake muffler, the second cylindrical portion comprising (i) a front side surface that faces the second intake muffler, (ii) an inner circumferential surface that defines a central opening axially through the front side surface, and (iii) the outer circumferential surface that surrounds the inner circumferential surface and is spaced apart from the inner circumferential surface, wherein the front side surface of the second cylindrical portion blocks a front portion of a body space that is defined between the inner circumferential surface and the outer circumferential surface, wherein a rear side of the second cylindrical portion is open rearward to a rear portion of the body space, wherein the muffler body further comprises a third flange extending inward from the inner circumferential surface of the second cylindrical portion, and wherein a rear surface of the second flange contacts a front surface of the third flange.

2. The linear compressor of claim 1, wherein a diameter of the second intake muffler is greater than a diameter of the first intake muffler.

3. The linear compressor of claim 1, wherein the first space is defined radially outside the first intake muffler, and wherein a part of the first space overlaps with the piston along an axial direction.

4. The linear compressor of claim 1, wherein the first communication hole is defined between the first flange and the second flange.

5. The linear compressor of claim 1, wherein the second muffler unit further comprises a muffler cover disposed between the muffler body and the back cover, and wherein the outer circumferential surface of the second intake muffler further defines a second communication hole between the first flange and the coupling portion, the second communication hole fluidly communicating the inside of the second intake muffler with a second space that is defined by the second intake muffler, the muffler body, the muffler cover, and the back cover.

6. The linear compressor of claim 5, wherein a diameter of the second space is greater than a diameter of the first space.

7. The linear compressor of claim 5, wherein the second intake muffler comprises a partition wall that partitions an inner space of the first cylindrical portion, and wherein the partition wall overlaps with the second space along the radial direction.

8. The linear compressor of claim 5, wherein the muffler cover comprises (i) a ring portion extending in a circumferential direction, (ii) a first extension extending from an outer circumference of the ring portion toward the back cover, and (iii) a second extension extending from an inner circumference of the ring portion toward the second intake muffler, and wherein the second cylindrical portion contacts the first extension and the second extension.

9. The linear compressor of claim 8, wherein the ring portion covers the rear portion of the body space between the inner circumferential surface and the outer circumferential surface of the second cylindrical portion, and wherein the second cylindrical portion contacts an outer surface of the first extension.

10. The linear compressor of claim 8, wherein the inner circumferential surface of the second cylindrical portion defines a resonance communication hole that fluidly communicates a third space defined between the second intake muffler and the second cylindrical portion with a fourth space defined between the second cylindrical portion and the ring portion.

11. A linear compressor comprising:

a cylinder;

a piston configured to axially reciprocate in the cylinder;

a back cover axially spaced apart from the piston, the back cover defining an opening at a central area in a radial direction; and a muffler unit comprising (i) an intake muffler coupled to the opening and (ii) a muffler body surrounding the intake muffler, wherein an outer circumferential surface of the intake muffler defines a first communication hole that fluidly communicates an inside of the intake muffler with a first space that is defined radially between the intake muffler and the muffler body, wherein the intake muffler comprises:

a first cylindrical portion, a first flange that extends radially outward from a front portion of the first cylindrical portion and radially overlaps with a front end of the muffler body, a second flange that extends radially outward from a central area of the first cylindrical portion, and a coupling portion that extends radially outward from a rear area of the first cylindrical portion and is coupled to the opening, wherein the muffler body comprises a second cylindrical portion disposed radially outside the intake muffler, the second cylindrical portion comprising (i) a front side surface that faces the intake muffler, (ii) an inner circumferential surface that defines a central opening axially through the front side surface, and (iii) the outer circumferential surface that surrounds the inner circumferential surface and is spaced apart from the inner circumferential surface, wherein the front side surface of the second cylindrical portion blocks a front portion of a body space that is defined between the inner circumferential surface and the outer circumferential surface, wherein a rear side of the second cylindrical portion is open rearward to a rear portion of the body space, wherein the muffler body further comprises a third flange that extends inward from the inner circumferential surface of the second cylindrical portion, and wherein a rear surface of the second flange contacts a front surface of the third flange.

12. The linear compressor of claim 11, wherein the first communication hole is defined between the first flange and the second flange.

13. The linear compressor of claim 11, wherein the muffler unit further comprises a muffler cover disposed between the muffler body and the back cover, and wherein the outer circumferential surface of the intake muffler further defines a second communication hole between the first flange and the coupling portion, the second communication hole fluidly communicating the inside of the intake muffler with a second space that is defined by the intake muffler, the muffler body, the muffler cover, and the back cover.

14. The linear compressor of claim 13, wherein a diameter of the second space is greater than a diameter of the first space.

15. The linear compressor of claim 13, wherein the intake muffler comprises a partition wall that partitions an inner space of the first cylindrical portion, and wherein the partition wall radially overlaps with the second space along the radial direction.

16. The linear compressor of claim 13, wherein the muffler cover comprises (i) a ring portion extending in a circumferential direction, (ii) a first extension extending from an outer end of the ring portion toward the back cover, and (iii) a second extension extending from an inner end of the ring portion toward the intake muffler, wherein the ring portion covers the rear portion of the body space between the inner circumferential surface and the outer circumferential surface of the second cylindrical portion, wherein the second cylindrical portion contacts an outer surface of the first extension and an inner surface of the second extension, and wherein the inner circumferential surface of the second cylindrical portion defines a resonance communication hole that fluidly communicates a third space defined between the intake muffler and the second cylindrical portion with a fourth space defined between the second cylindrical portion and the ring portion.

* * * * *